US006193897B1

(12) United States Patent
Nikaido et al.

(10) Patent No.: US 6,193,897 B1
(45) Date of Patent: Feb. 27, 2001

(54) SHADOW MASK MANUFACTURING METHOD, SHADOW MASK MANUFACTURING APPARATUS, AND CLEANING DEVICE USED IN THE METHOD AND APPARATUS

(75) Inventors: Masaru Nikaido; Sachiko Hirahara, both of Fukaya; Yukio Okudo, Himeji; Daizi Hirosawa, Fukaya; Hiroharu Takezawa, Isesaki, all of (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 08/887,456

(22) Filed: Jul. 2, 1997

(30) Foreign Application Priority Data

Jul. 2, 1996 (JP) ..... 8-172280
Sep. 5, 1996 (JP) ..... 8-235527
Oct. 8, 1996 (JP) ..... 8-266444

(51) Int. Cl.[7] ..... B44C 1/22
(52) U.S. Cl. ..... 216/12; 216/100; 134/2
(58) Field of Search ..... 216/12, 100; 134/55, 134/2, 72, 198

(56) References Cited

U.S. PATENT DOCUMENTS 4,798,218 * 1/1989 Sauvan ..... 134/74
5,118,357 6/1992 Sabatka ..... 134/15
5,200,025 * 4/1993 Toei et al. ..... 216/17
5,265,629 * 11/1993 Sajewski ..... 134/58 R
5,326,663 7/1994 Tanaka et al. ..... 430/23
5,383,483 * 1/1995 Shibano ..... 134/111
5,484,074 * 1/1996 Deibler et al. ..... 216/12
5,908,509 * 6/1999 Olesen et al. ..... 134/1.3

FOREIGN PATENT DOCUMENTS 314 110 A2 5/1989 (EP) .
0 443 380 8/1991 (EP) .
521 721 A2 1/1993 (EP) .
2 143 254 2/1985 (GB) .
4-303933 10/1992 (JP) .
6-208098 7/1994 (JP) .

* cited by examiner

*Primary Examiner*—Randy Gulakowski
*Assistant Examiner*—Shamim Ahmed
(74) *Attorney, Agent, or Firm*—Pillsbury Madison & Sutro LLP

(57) ABSTRACT

A shadow mask manufacturing method comprising the cleaning step performs rapid cleaning by spraying a cleaning solution, which is inert with respect to the band-like thin metal plate, upon upper and lower surfaces of the band-like thin metal plate and thereby generating cavitation near the surfaces of the band-like thin metal plate by using cavitation jet means, while regulating a position of the band-like thin metal plate and preventing the cleaning solution from leaking in a direction opposite to the conveyance direction of the band-like thin metal plate by using a first leakage-preventing seal unit provided upstream the cavitation jet means.

14 Claims, 15 Drawing Sheets

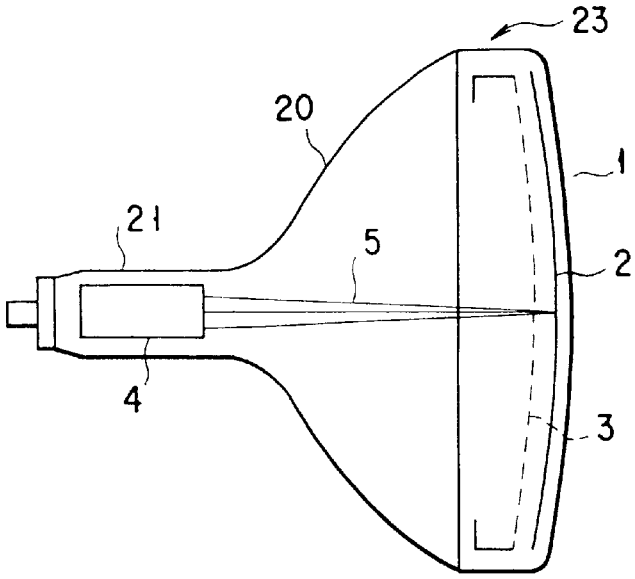
FIG. 1
FIG. 2
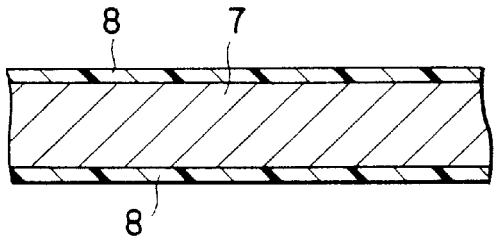
FIG. 3
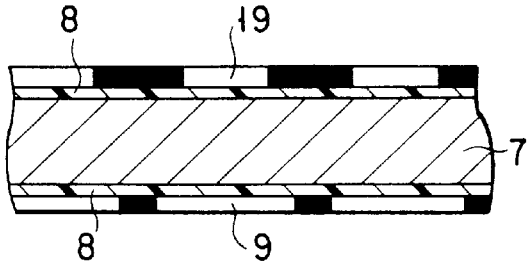
FIG. 4
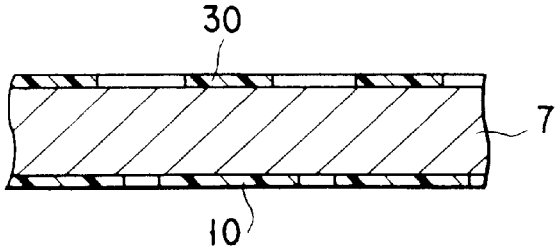

SHADOW MASK MANUFACTURING METHOD, SHADOW MASK MANUFACTURING APPARATUS, AND CLEANING DEVICE USED IN THE METHOD AND APPARATUS

BACKGROUND OF THE INVENTION

The present invention relates to a method of manufacturing a shadow mask for a color picture tube and, more particularly, to a shadow mask manufacturing method using photoetching.

The present invention also relates to a cleaning device used in a shadow mask manufacturing process.

Furthermore, the present invention relates to an apparatus for manufacturing a shadow mask.

As shown in FIG. 1, a shadow mask type color picture tube has a vacuum envelope 23 consisting of a panel 1, a cone 20, and a neck 21. In this vacuum envelope 23, a phosphor screen 2, a shadow mask 3, and an electron gun 4 are arranged. The phosphor screen 2 is formed on the inner surface of the panel 1 and consists of three kinds of phosphor layers emitting three different colors, respectively. The shadow mask 3 is arranged as a color selection electrode apart from the phosphor screen 2 by a predetermined distance and has a large number of apertures arranged in a predetermined manner and having a predetermined shape. The electron gun 4 is provided in the neck.

In a shadow mask type color picture tube, this shadow mask 3 selects three electron beams 5 emitted from the electron gun 4 so that these electron beams correctly land on the respective predetermined phosphor layers.

The phosphor screen 2 has phosphor dots or stripes and a black matrix burying the portions between these dots or stripes (none of them is shown). This black matrix absorbs landing errors of the electron beams 5 and improves the contrast.

The shapes of the apertures in the shadow mask 3 are roughly classified into a circle and a rectangle. In principle, shadow masks having circular apertures are used in color display tubes for displaying characters and graphics, and shadow masks having rectangular apertures are used in general home color picture tubes.

Recently, a high definition and a high quality are strongly demanded on color display tubes. Accordingly, efforts are being made to decrease the size of apertures in a shadow mask and reduce variations in the aperture size. This is because a shadow mask is used in the formation of a phosphor screen. Generally, in color picture tubes, a phosphor screen for displaying images is formed by photolithography by using a shadow mask as a photomask. For this reason, the size and shape of matrix apertures of a black matrix or of dot-like phosphor layers of three emitting colors constituting this phosphor screen grate depend upon the size and shape of apertures in the shadow mask used. Variations in the size and shape of apertures in the shadow mask appear as unevenness of displayed images and degrade the image quality.

Conventionally, the apertures in shadow masks are formed by photoetching. In particular, apertures are usually formed by a two-stage etching process in display tube shadow masks requiring a high definition and a high quality.

FIGS. 2 to 8 are schematic views for explaining a conventional two-stage etching process.

As a substrate of a color display tube shadow mask, a thin metal plate 7 made from, e.g., an invar material consisting of an Fe—Ni alloy containing such as 36 wt % of Ni or aluminum killed steel is used. This thin metal plate 7 is subjected to degreasing and cleaning to remove, e.g., rolling oil and rust preventing oil.

Photosensitive film formation step

As shown in FIG. 2, both two surfaces of the degreased thin metal plate 7 are coated with a photosensitive material made from, e.g., casein or modified PVA. The coated photosensitive material is dried to form resist films 8 as photosensitive films.

Exposure step

As shown in FIG. 3, a pair of masters 9 and 19 are prepared. The master 9 has a pattern corresponding to small apertures formed in the surface of a shadow mask, that faces an electron gun. The master 19 has a pattern corresponding to large apertures formed in the surface of the shadow mask, that faces a phosphor screen. These masters 9 and 19 are attached to the resist films 8 on the two surfaces of the thin metal plate 7. Thereafter, exposure is performed to print the patterns of the masters 9 and 19 onto the resist films 8. Since a variation in the exposure amount in the exposure area has an influence on the pattern formation dimensions of the resist films 8, the exposure amount is controlled within a predetermined range.

Development step

The resist films 8 on the both surfaces of which the patterns are transferred are developed by using a developer consisting of water or water and alcohol, thereby removing unexposed portions. Consequently, as shown in FIG. 4, resist films 10 and 30 having patterns corresponding to patterns of the pair of masters described above are formed.

First etching step

Thereafter, a protective film 31 is prepared. This protective film 31 consists of an etching-resistant resin film made from polyethyleneterephthalate (PET) or casting polypropylene (CPP) and a pressure-sensitive adhesive applied on the surface of the etching-resistant resin film. As shown in FIG. 5, the protective film 31 is adhered by using the pressure-sensitive adhesive to the surface on which the resist film 30 is formed. The surface of the thin metal plate 7 on which the resist film 10 is formed is etched by using a ferric chloride solution as an etching solution. Consequently, small concave holes 12 serving as small apertures to be formed in the surface of a shadow mask, that faces an electron gun are formed in the surface of the thin metal plate 7 on which the resist film 10 is formed.

Etching-resistant layer formation step

Subsequently, the protective film 31 attached on the surface on which the resist film 30 is formed is removed. The resist film 10 on the surface in which the small concave holes 12 are formed is stripped, and the resultant surface is washed with water. Thereafter, as shown in FIG. 6, the surface of the thin metal plate 7 in which the small concave holes 12 are formed and the interiors of these small concave holes 12 are coated with varnish, and the varnish is dried to form an etching-resistant layer 13.

A protective film 11 is adhered to this etching-resistant layer 13.

Second etching step

Thereafter, the surface of the thin metal plate 7 on which the resist film 30 is formed is etched with an etching solution. Consequently, as shown in FIG. 7, large concave holes 32 serving as large apertures formed in the surface of a shadow mask, that faces a phosphor screen are formed on the surface on which the resist film 30 is formed.

Finishing step

The protective film 11 is removed, and the resist film 30 on the surface in which the large concave holes 32 are formed and the etching-resistant layer 13 on the surface in which the small concave holes 12 are formed are stripped off using an aqueous alkali solution. Consequently, as shown in FIG. 8, the small concave holes 12 and the large concave holes 32 communicate with each other to form apertures 14.

A shadow mask is manufactured through the steps described above.

Although this method is generally used, the method has the problem of variations in the size and shape of apertures in a shadow mask. This is caused by some factors described below.

First, etching reproceeds by the etching solution remaining in the concave holes 12 and 32 during cleaning after etching.

This reproceeding will be described below with reference to FIG. 9 by using the large concave hole 32 as an example. FIG. 9 is a view for explaining the condition of a thin metal plate immediately after the second etching step. After the second etching step, as shown in FIG. 9, an opening diameter De of the concave hole 32 is larger than an opening diameter Dr of the resist film 30 due to side-etching. As a result, an overhanging portion 15 of the resist film 30 is formed around the opening of the concave hole 32. A relatively large amount of etching solution 16 remains inside the overhanging portion 15. The etching solution thus remaining in the concave holes 12 and 32 is difficult to well remove and displace well with wash water within a short time period even by spraying the wash water. Also, the displacement rate of the wash water differs from one concave hole to another.

The influence of the residual etching solution will be described below with reference to FIG. 10. FIG. 10 is a graph showing the relationship between the concentration of the ferric chloride solution and the etching rate. As indicated by a curve 18, as shown in FIG. 10, initially an increase in concentration of the ferric chloride corresponds to an increase in etching rate. The etching rate peaks at a certain level of concentration of the ferric chloride. The etching rate decreases gradually and becomes relatively constant as the concentration increases. A ferric chloride solution with a concentration around the concentration indicated by the broken line is normally used in the etching step for decreasing the variation of the etching rate with respect to the change in concentration of the etching solution. However, if cleaning using wash water is insufficient, the etching solution remaining in the concave holes is diluted with the cleaning solution. The concentration of the diluted etching solution differs from one concave hole to another, and etching reproceeds at an etching rate corresponding to the concentration of the etching solution. When a thin metal plate is exposed to a low-concentration ferric chloride solution diluted by washing after etching for a long time period as described above, the aperture size of the obtained shadow mask changes as shown in FIG. 8. This results in variations in the aperture size and shape and mottling unevenness.

The second factor is poor cleanness of a thin metal plate itself. This cleanness is particularly a problem before the formation of the photosensitive film and after the stripping of the photosensitive film. If the cleanness is poor before the formation of the photosensitive film, satisfactory adhesion may not be obtained between the photosensitive film and the thin metal plate. If the cleanness is poor after the stripping of the photosensitive film, it is likely that coating and filling of the varnish when the etching-resistant layer is formed become nonuniform and no good adhesion is obtained between the etching-resistant layer and the thin metal plate. The cleanness after the stripping of the photosensitive film is especially crucial when the etching-resistant layer is formed in the subsequent step.

BRIEF SUMMARY OF THE INVENTION

The present invention has been made to solve the above conventional problems and has as its first object to obtain a shadow mask having no variations in the aperture size and shape by improving the cleaning step to perform sufficient cleaning in a shadow mask manufacturing method.

It is the second object of the present invention to provide an improved cleaning device for well cleaning a thin metal plate used in a shadow mask.

It is the third object of the present invention to obtain a shadow mask having no variations in the aperture size and shape by performing sufficient cleaning by using the improved cleaning device.

According to the first aspect of the present invention, there is provided a shadow mask manufacturing method comprising the step of forming etching protective layers, each of which has a pattern corresponding to apertures in a shadow mask on at least one surface thereof, on two major surfaces of a thin metal plate having the two major surfaces, the etching step of etching the thin metal plate on which the etching protective layers are formed by using an etching solution containing ferric chloride, and the cleaning step of removing the etching solution by displacing the etching solution with an etching inhibiting solution which is inert with respect to the thin metal plate after the etching step.

According to the second aspect of the present invention, there is provided a cleaning device for a thin metal plate, comprising a cleaning unit having cavitation jet means for performing rapid cleaning by spraying a cleaning solution, which is inert with respect to a band-like thin metal plate conveyed along a longitudinal direction while being held nearly horizontal, upon upper and lower surfaces of the band-like thin metal plate and thereby generating cavitation near the surfaces of the thin metal plate, and a first leakage-preventing seal unit arranged before the cleaning unit to regulate a position of the band-like thin metal plate and prevent the cleaning solution from leaking in a direction opposite to the conveyance direction of the band-like thin metal plate.

According to the third aspect of the present invention, there is provided a shadow mask manufacturing apparatus comprising, an etching unit for etching a band-like thin metal plate on two surfaces of which etching protective layers each having a pattern corresponding to apertures in a shadow mask on at least one surface thereof are formed, an etching protective layer stripping unit for stripping the etching protective layers, and a cleaning device for cleaning the band-like thin metal plate, by using a cleaning solution, wherein the cleaning device comprises a first leakage-preventing seal unit for regulating a position of the band-like thin metal plate and preventing the cleaning solution from leaking in a direction opposite to the conveyance direction of the band-like thin metal plate, and a cleaning unit provided after the first leakage-preventing seal unit and having cavitation jet means for performing rapid cleaning by spraying a cleaning solution, which is inert with respect to the band-like thin metal plate, upon upper and lower surfaces of the band-like thin metal plate and thereby generating cavitation near the surfaces of the band-like thin metal plate.

According to the fourth aspect of the present invention, there is provided a shadow mask manufacturing method comprising the step of etching a band-like thin metal plate on two surfaces of which etching protective layers each having a pattern corresponding to apertures in a shadow mask on at least one surface thereof are formed, the etching protective layer stripping step of stripping the etching protective layers, and the step of performing rapid cleaning by spraying a cleaning solution, which is inert with respect to the band-like thin metal plate, upon upper and lower surfaces of the band-like thin metal plate and thereby generating cavitation near the surfaces of the bandlike thin metal plate by using cavitation jet means, while regulating a position of the band-like thin metal plate and preventing the cleaning solution from leaking in a direction opposite to the conveyance direction of the band-like thin metal plate by using a first leakage-preventing seal unit provided before the cavitation jet means.

In the shadow mask manufacturing method according to the first aspect of the present invention, resists each having a pattern corresponding to the apertures in a shadow mask are formed on the two surfaces of a thin metal plate. The thin metal plate on which these resists are formed is etched. Thereafter, the etching solution adhering to the thin metal plate, particularly the etching solution remaining in concave holes formed by etching is removed and displaced with an etching inhibiting solution which is inert with respect to the thin metal plate. Since this suppresses variations in the aperture size and shape, a uniform, high-quality shadow mask can be manufactured.

Also, when the cleaning device according to the second aspect of the present invention is used, it is possible to efficiently supply a cleaning solution to a limited range on the upper and lower surfaces of a metal substrate held nearly horizontal and generate uniform and fine cavitation near the upper and lower surfaces. Therefore, cleaning by displacing the etching solution with an etching inhibiting solution can be performed well within a short time period.

Furthermore, when the shadow mask manufacturing apparatus and the shadow mask manufacturing method according to the third and fourth aspects, respectively, of the present invention are used, it is possible to efficiently supply a cleaning solution to a limited range on the upper and lower surfaces of a metal substrate held nearly horizontal and generate uniform and fine cavitation near the upper and lower surfaces. Therefore, an etching solution can be well cleaned and displaced with an etching inhibiting solution within a short time period. Since this suppresses variations in the aperture size and shape, a uniform, high-quality shadow mask can be manufactured.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a schematic view showing the structure of a general shadow mask type color picture tube;

FIGS. 2 to 8 are sectional views for explaining a conventional two-stage etching method;

DETAILED DESCRIPTION OF THE INVENTION

Figure 5:
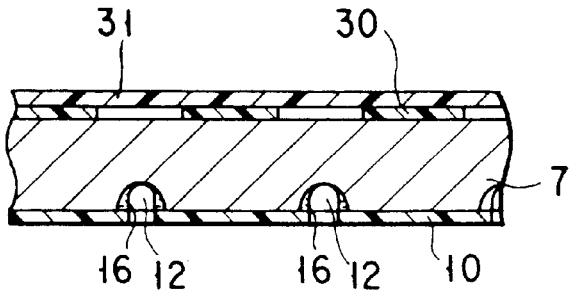
Figure 6:
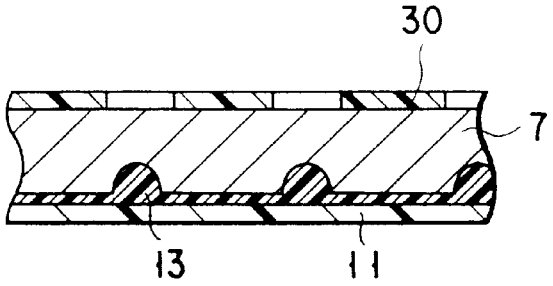
Figure 7:
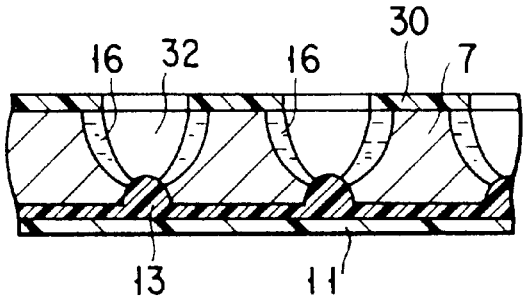
Figure 8:
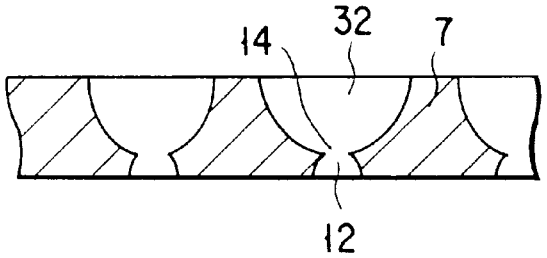

The present invention is roughly classified into the following four aspects.

According to the first aspect, there is provided a shadow mask manufacturing method including a cleaning step using an improved cleaning solution.

According to the second aspect, there is provided an improved cleaning device for a thin metal plate, which can be used in the cleaning step of the shadow mask manufacturing method.

According to the third aspect, there is provided a shadow mask manufacturing apparatus using the improved cleaning device for a thin metal plate.

Furthermore, according to the fourth aspect, there is provided a shadow mask manufacturing method using an improved cleaning step of cleaning a thin metal plate.

These aspects of the present invention will be described in more detail below in the order named.

The shadow mask manufacturing method according to the first aspect comprises the step of forming etching protective layers, each of which has a pattern corresponding to apertures in a shadow mask on at least one surface thereof, on two major surfaces of a thin metal plate having the two major surfaces, the etching step of etching the thin metal plate on which the etching protective layers are formed by using an etching solution containing ferric chloride, and the cleaning step of removing the etching solution by using a cleaning solution after the etching step, wherein the cleaning solution is an etching inhibiting solution which is inert with respect to the thin metal plate.

This shadow mask manufacturing method can be applied to either a both-sided simultaneous etching method by which apertures are formed by simultaneously etching the both sides of a thin metal plate or a two-stage etching method by which apertures are formed by separately etching each surface in two stages. Either method is characterized in that the ferric chloride etching solution remaining on the thin metal plate is removed and displaced, as soon as possible, with the etching inhibiting solution which is inert with respect to the thin metal plate.

As for the etching inhibiting solution, it is possible to use cold water, alcohol, or a solution or a mixture of two or more solutions selected from solutions containing a metal ion with a higher ionization a tendency than that of a trivalent iron. Examples are an aqueous nickel chloride solution, an aqueous cobalt chloride solution, an aqueous potassium chloride solution, an aqueous calcium chloride solution, an aqueous magnesium chloride solution, an aqueous lithium chloride solution, an aqueous zinc chloride solution, an aqueous manganese chloride solution, and an aqueous ferrous chloride solution. Note that the cold water herein mentioned is water at a temperature of 5 to 20° C. in the present invention.

In addition when an etching inhibiting solution containing a metal ion having a higher ionization tendency than that of trivalent iron is used, the concentration of ion of this metal whose ionization tendency is higher than that of trivalent iron is preferably prepared to a saturated concentration of a salt of the metal.

To confirm the inhibitory effect of the etching inhibiting solutions, a plurality of different solutions were prepared by mixing the etching inhibiting solution consisting of each saturated aqueous solution of metal salts at the temperature of 20° C. and a ferric chloride solution having specific gravity of 1,555 by changing their weight ratio. A thin metal plate made from invar commercially available from HITACHI KINZOKU and having dimensions of 1 cm×2 cm×0.13 mm was dipped in each solution for 1 min.

Figure 11:
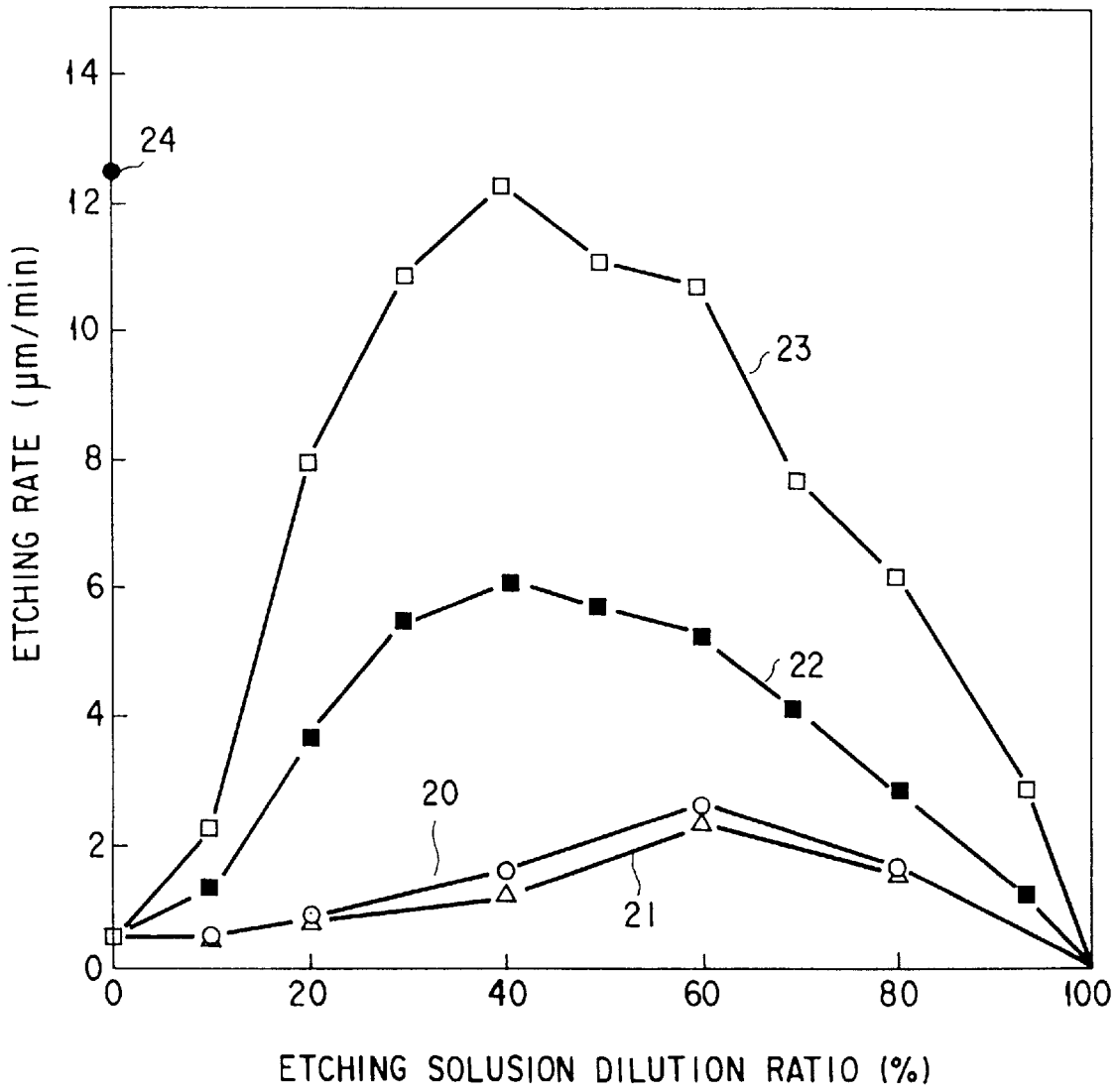
FIG. 11 is a graph showing the relationship between the dilution ratio of the etching inhibiting solution to the ferric chloride solution and the etching amount per unit area of the thin metal plate.

FIG. 11 is a graph showing the relationship between the dilution ratio of the etching inhibiting solution to the ferric chloride solution and the etching amount per unit area of the thin metal plate. In FIG. 11, a curve 20 indicates nickel chloride, a curve 21 indicates manganese chloride, a curve 22 indicates cold water, curve 23 indicates water used as a control, and a point 24 indicates an etching rate at a temperature when an etching step is performed.

As can be seen from FIG. 11, cold water 22, nickel chloride 20, and manganese chloride 21 had a larger inhibitory effect than that of water 23, and particularly the effect of manganese chloride was large. This is attributed to the fact that the solubility of manganese chloride is larger than that of nickel chloride, a large amount of manganese chloride is soluble, and that the ionization energy of manganese is larger than those of nickel and iron. Although the inhibitory effect of cold water is inferior to those of nickel chloride and manganese chloride, cold water has an effect of decreasing the reaction rate of the etching solution by lowering the temperature. The etching inhibiting solution used in the present invention is desired to have an etching inhibiting effect larger than at least the etching inhibiting effect of cold water. As is apparent from FIG. 11, when cold water was used in the shadow mask of the present invention, the etching rate was 6 μm/min or less. Accordingly, in the shadow mask manufacturing method of the present invention, the etching rate is preferably 6 μm/min or less.

The etching solution sticking to a thin metal plate is removed and displaced with the etching inhibiting solution as described above. Consequently, it is possible to inhibit the high-speed etching capacity of the diluted ferric chloride solution.

As the cleaning means used in the present invention, it is effective to use at least one means selected from a cavitation jet, megasonic shower, slit nozzle shower, and sponge roll.

When any of these means is used, the etching solution remaining to a thin metal plate, particularly the etching solution remaining in apertures or concave holes formed by etching can be well displaced with the etching inhibiting solution within a short time period after etching. Additionally, the time during which a thin metal plate and a dilute etching solution with a high etching rate contact each other can be reduced. Since this suppresses a change in the aperture size and variations in the aperture size and shape, a high-quality shadow mask with a high uniformity can be manufactured.

The shadow mask manufacturing method of the present invention will be described in more detail below with reference to the accompanying drawings.

FIGS. 12 to 20 are schematic sectional views for explaining the first preferred embodiment of the shadow mask manufacturing method according to the first aspect of the present invention.

In this embodiment, a thin metal plate made from a 0.12-mm thick invar material was used as a shadow mask substrate, and apertures were formed by a two-stage etching method.

First, rolling oil and rust which prevent oil sticking to the surfaces of the thin metal plate were removed by an alkali degreasing solution, and the thin metal plate was washed with water and dried.

Photosensitive film formation step

Figure 12:
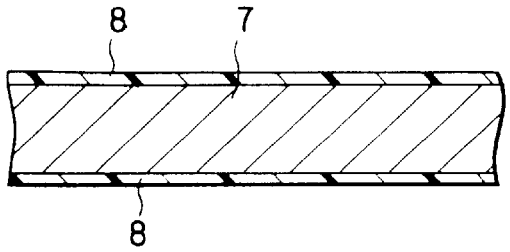
FIGS. 12 to 20 are sectional views for explaining the first preferred embodiment of a shadow mask manufacturing method according to the first aspect of the present invention.

Thereafter, as shown in FIG. 12, the two surfaces of the thin metal plate 7 were coated with a photo-sensitive material primarily consisting of casein and dichromate, and the photosensitive material was dried to form resist films 8 with a thickness of a few μm.

Exposure step

Figure 13:
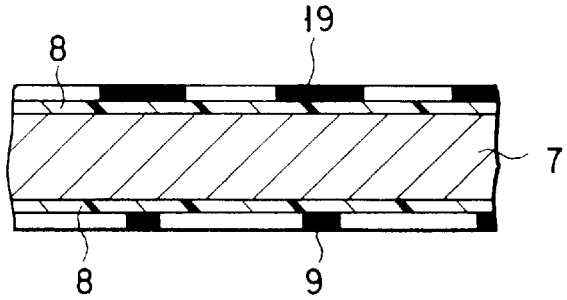

Subsequently, as shown in FIG. 13, a pair of masters 9 and 19 were prepared. The master 9 had a pattern corresponding to small apertures formed in a surface of a shadow mask that faces an electron gun. The master 19 had a pattern corresponding to large apertures formed in a surface of the shadow mask that faces a phosphor screen. These masters 9 and 19 were attached to the resist films 8 on the both surfaces of the thin metal plate 7. Thereafter, exposure was performed to print the patterns of the masters 9 and 19 onto the resist films 8.

Development step

Figure 14:
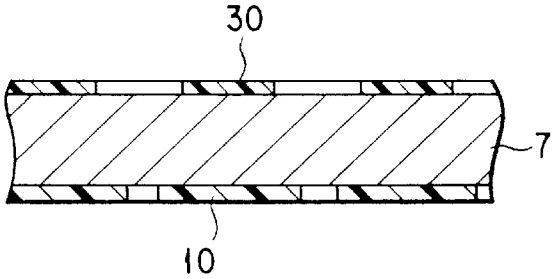

The resist films 8 on the both surfaces of which the patterns were transferred were developed by using water or a developer consisting of water and alcohol, thereby removing unexposed portions. Consequently, as shown in FIG. 14, resist films 10 and 30 as etching protective layers having patterns corresponding to the patterns of the pair of masters described above were formed.

First etching step

Figure 15:
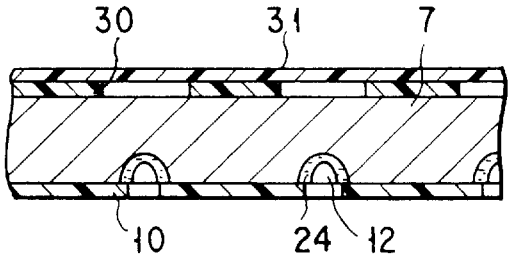

Thereafter, a protective film 31 was prepared. This protective film 31 consisted of an etching-resistant resin film made from polyethyleneterephthalate (PET) or casting polypropylene (CPP) and a pressure-sensitive adhesive applied on the surface of the etching-resistant resin film. As shown in FIG. 15, the protective film 31 was adhered by using the pressure-sensitive adhesive to the surface on which the resist film 30 was formed. The surface of the thin metal plate 7 on which the resist film 10 was formed was faced down and etched by spraying a ferric chloride solution as an etching solution. Consequently, small concave holes 12 serving as small apertures to be formed in the surface of a shadow mask that faces an electron gun were formed in the surface of the thin metal plate 7 on which the resist film 10 was formed.

Cleaning step using etching inhibiting solution

Figure 16:
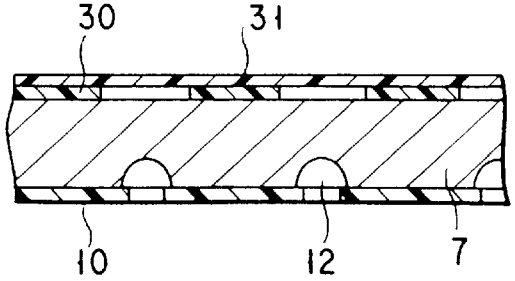

After the first etching step, an aqueous nickel chloride solution as an inert etching inhibiting solution was applied with ultrasonic waves in a megahertz band and sprayed directly upon the thin metal plate 7 by a megasonic shower means. Consequently, an etching solution 24 remaining on the surface of the thin metal plate 7, particularly in the small concave holes 12, was displaced with the aqueous nickel chloride solution. That is, as shown in FIG. 16, the etching solution remaining on the surface of the thin metal plate 7, particularly in the small concave holes 12, was thus removed, and the resultant material was washed with water.

Resist stripping and protective film removal step

Subsequently, the resist film 10 on the surface on which the small concave holes 12 were formed was stripped off by using an aqueous 10% alkali solution heated to 90° C., and the resultant material was washed with water. Thereafter, the protective film 31 adhering the surface on which the resist 30 was formed was removed. The resist film 10 on the surface on which the small concave holes 12 were formed were stripped, and the resultant material was washed with water.

Etching-resistant layer formation step

Figure 17:
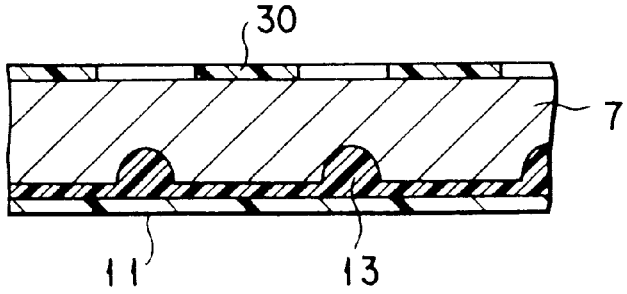

Next, as shown in FIG. 17, the surface of the thin metal plate 7 in which the small concave holes 12 were formed and the interiors of these small concave holes 12 were coated with varnish, and the varnish was dried to form an etching-resistant layer 13. A protective film 11 made from, e.g., a PET resin was adhered to this etching-resistant layer 13.

Second etching step

Figure 18:
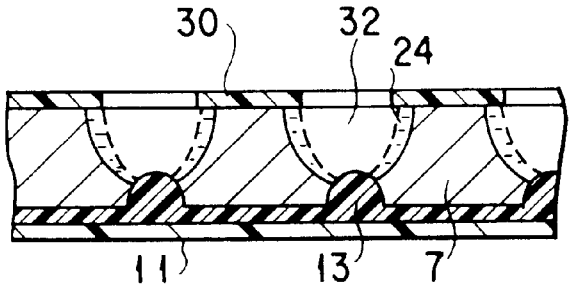

Thereafter, as shown in FIG. 18, the surface on which the resist 30 was formed was faced down and etched by spraying an etching solution containing ferric chloride. Consequently, large concave holes 32 serving as large apertures formed in the surface of a shadow mask, that faces a phosphor screen were formed on the surface on which the resist film 30 was formed.

Cleaning step using etching inhibiting solution

Figure 19:
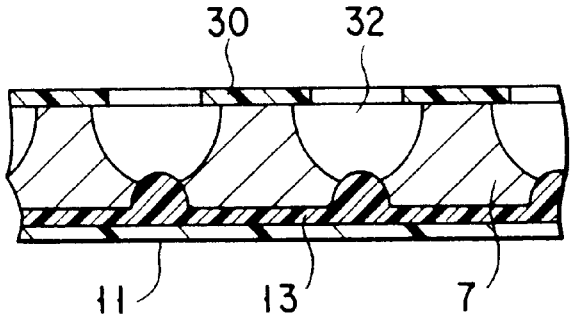

After this second etching step, as when the first etching step was completed, an aqueous nickel chloride solution as an inert etching inhibiting solution was applied with ultrasonic waves in a megahertz band and sprayed directly upon the thin metal plate by a megasonic shower means. Consequently, the etching solution 24 remaining on the surface of the thin metal plate, particularly in the large concave holes 32 was removed and displaced with the aqueous nickel chloride solution. That is, as shown in FIG. 19, the etching solution remaining in the large concave holes 32 was thus removed, and the resultant material was washed with water.

Finishing step

Figure 20:
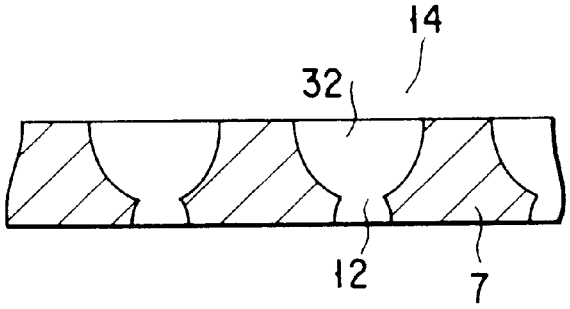

The protective film 11 adhering to the other surface was removed, and the resist film 30 on the surface in which the large concave holes 32 were formed and the etching-resistant layer 13 on the surface in which the small concave holes 12 were formed were stripped off by an aqueous 10% alkali solution heated to 90° C. Thereafter, the resultant material was washed with water. Consequently, as shown in FIG. 20, the small concave holes 12 and the large concave holes 32 communicated with each other to form apertures 14.

When the apertures 14 of the shadow mask are formed by the above method, not only the etching solution adhering to the surfaces of the thin metal plate but also the etching solution remaining in the concave holes 12 and 32 can be well displaced within short time periods by a high etching inhibiting effect of the aqueous nickel chloride solution and by a high energy application from the megasonic shower.

Figure 9:
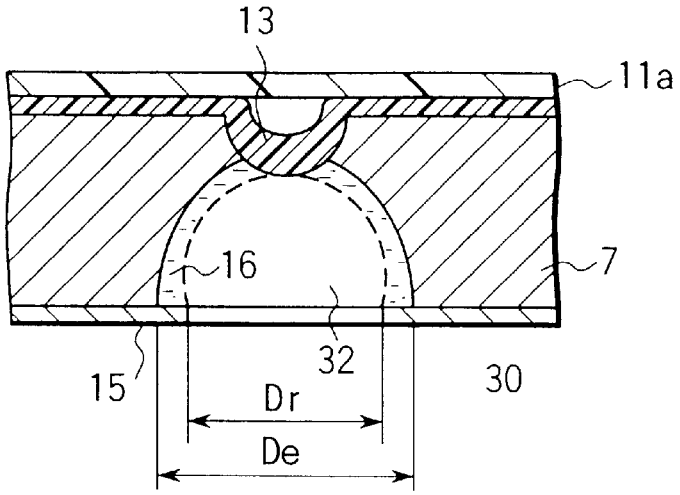
FIG. 9 is a sectional view after second etching.
Figure 10:
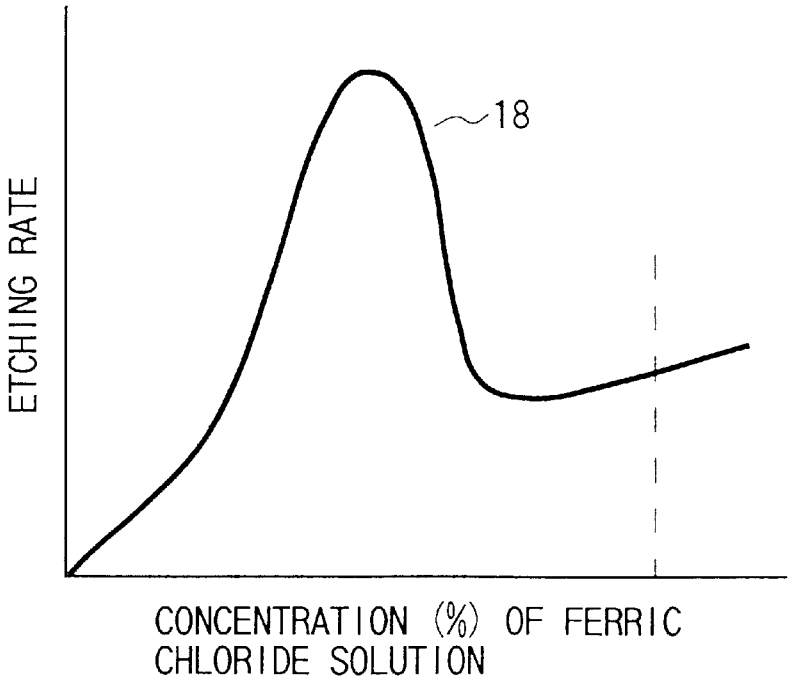
FIG. 10 is a graph showing the relationship between the concentration of the ferric chloride solution and the etching rate.

When the concave holes 12 and 32 are formed by etching as described above, the opening diameters of these concave holes 12 and 32 are larger than the opening diameters of the resist film 10 and 30 due to progress of side-etching. Consequently, overhanging portions are formed in the resist film 10 and 30, and, as shown in FIG. 9, a relatively large amount of etching solution remains inside each overhanging portion. Conventional spray washing cannot rapidly dilute and remove the etching solution remaining inside the overhanging portion. Therefore, the material is exposed to the dilute etching solution with a high etching rate for a long time period, resulting in variations in the aperture size and shape. However, when the method of the present invention is used, with the etching inhibiting effect of nickel chloride the combined effect suppresses variations in the aperture size and shape caused by the dilute etching solution. Consequently, a high-quality shadow mask with a high uniformity can be manufactured. Also, cleaning and displacement can be well performed within shorter time periods by the use of megasonic shower.

Figure 21:
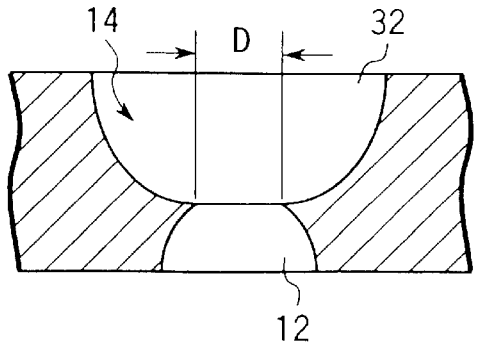
FIG. 21 is an enlarged sectional view of an aperture 14.

FIG. 21 is an enlarged view of the aperture 14. As shown in FIG. 21, an aperture diameter D is defined by the connecting portion between the small concave hole 12 and the large concave hole 32. When a shadow mask whose aperture diameter was set to 115 μm was manufactured by a conventional method, a variation $3\sigma$ in the aperture diameter D was 3.6 μm. However, in the first preferred embodiment according to this first aspect, the variation 3σ in the aperture diameter D can be decreased to 1.8 μm, i.e., ½.

Also, to confirm the uniformity of these shadow masks, the shadow masks were checked by placing them on a light box using fluorescent lamps having a color temperature of 5700° C. Consequently, the uniformity of the shadow masks manufactured by the first preferred embodiment according to the first aspect of the present invention was greatly improved compared to that of the shadow masks manufactured by the conventional method.

The second preferred embodiment of the shadow mask manufacturing method according to the first aspect of the present invention will be described below.

First, following the same procedure as in the above first embodiment, a resist film with an opening diameter of 80 μm was formed on one surface of a 0.13-mm thick band-like thin metal plate, and a resist film with an opening diameter of 130 μm was formed on the other surface of the thin metal plate. The thin metal plate on which these resist films were formed was etched by a two-stage etching method.

Figure 22:
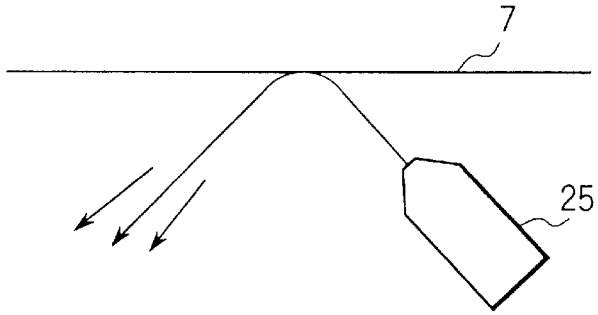
FIG. 22 is a view for explaining the way an etching solution is removed by using a slit nozzle used in a second etching step.

In this second preferred embodiment, in the formation of small concave holes in a first etching step, an etching solution is not displaced with an etching inhibiting solution after the small concave holes were formed. That is, the material was washed with a spray of water as in conventional methods, and large concave holes were formed in a second etching step. FIG. 22 is a view for explaining a method of removing an etching solution by using a slit nozzle in the second etching step. As shown in FIG. 22, a band-like thin metal plate 7 was conveyed with the surface in which the large concave holes were formed facing down, and a slit nozzle 25 arranged below the band-like thin metal plate 7 in the widthwise direction of the thin metal plate 7 sprayed a slit nozzle shower of a saturated aqueous manganese chloride solution upon the surface in which the large concave holes were formed, thereby displacing an etching solution. The rest of the etching was done following the same procedure as in the first preferred embodiment of the first aspect. In this manner, apertures were formed. These apertures consisted of small concave holes with an opening diameter of 118 μm formed in one surface that faces an electron gun and large concave holes with an opening diameter of 235 μm formed in the other surface that faces a phosphor screen. In each of these apertures, the connecting portion formed between the small concave hole and the large concave hole to define the aperture diameter was 15 μm away from the surface in which the small concave holes were formed.

Since a high etching inhibiting effect of the saturated aqueous manganese chloride solution and the power of the slit nozzle shower suppressed variations in the aperture size and shape, a high-quality shadow mask with a high uniformity was obtained.

The third preferred embodiment of the shadow mask manufacturing method according to the first aspect of the present invention will be described below.

In the third preferred embodiment, following the same procedure as in the first preferred embodiment, a resist film with an opening diameter of 100 μm was formed on one surface of a 0.13-mm thick band-like thin metal plate, and a resist film with an opening diameter of 110 μm was formed on the other surface of the thin metal plate.

The band-like thin plate on which these resist films were formed was etched by using a two-stage etching method. In this third embodiment, in the formation of small concave holes in a first etching step, an etching solution is not displaced with an etching inhibiting solution after the small concave holes were formed. That is, the material was washed with a spray of water as in conventional methods, and large concave holes were formed in a second etching step. Thereafter, the etching solution was removed and displaced with cold water by using sponge roll. The rest of the two-stage etching was done following the same procedure as in the first preferred embodiment.

In this manner, apertures were formed. These apertures consisted of small concave holes with an opening diameter of 188 μm formed in one surface, that faces an electron gun and large concave holes with an opening diameter of 235 μm formed in the other surface that faces a phosphor screen. In each of these apertures, the connecting portion formed between the small concave hole and the large concave hole to define the aperture diameter was 15 μm away from the surface in which the small concave holes were formed.

Figure 23:
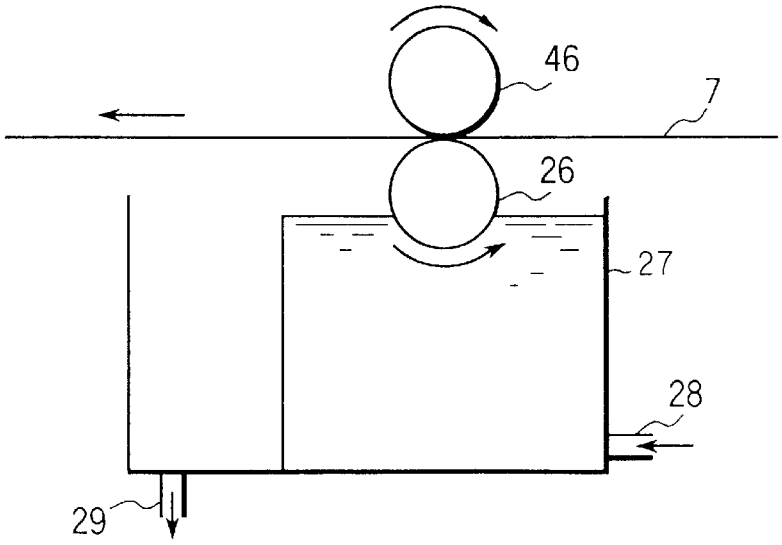
FIG. 23 is a schematic view of an etching solution cleaning device used in the third preferred embodiment.

FIG. 23 is a schematic view of an etching solution displacement device used in the third preferred embodiment. This displacement device is arranged after the second etching step and includes a pair of sponge roll 26 and 46 urged against the both surfaces of a band-like thin metal plate 7 which is conveyed with the surface in which the large concave holes are formed facing downward, and a cold water tank 27 arranged below the band-like thin metal plate 7. This cold water tank 27 has a cold water injection port 28 and a drainage port 29. A predetermined water level is always held by overflowing cold water injected from the cold water injection port 28. The sponge roll brushes 26 and 46 are formed so as to have a diameter of, e.g., about 15 μm and rotated by the respective driving devices (not shown) at the same peripheral speed as the conveyance speed of the band-like thin metal plate 7. A portion of about half the diameter of the sponge roll brush 26 arranged below the band-like thin metal plate 7 is dipped in cold water in the cold water tank 27.

In this etching solution displacement device, cold water penetrates well into the sponge roll 26 because a portion of about half the diameter of the sponge roll 26 is dipped in cold water. This penetrating cold water is supplied to the band-like thin metal plate 7 urged against the sponge roll brush 26 as the sponge roll 26 is rotated. The cold water is forcedly supplied particularly into the large concave holes formed in the second etching step. Consequently, the etching solution remaining in the large concave holes can be well displaced within a short time period.

As shown in FIG. 11, the etching inhibiting effect of cold water is inferior to that of an aqueous nickel chloride solution or an aqueous manganese chloride solution. However, cold water is forcedly pushed into the large concave holes by the sponge roll brush 26, and this accelerates the clean-up and displacement and shortens the time during which the material is exposed to the dilute etching solution with a high etching rate. Additionally, the reaction speed is lowered because cold water lowers the temperature of the dilute etching solution, so a satisfactory etching inhibiting effect is obtained. Consequently, it was possible to suppress variations in the aperture size and shape and obtain a high-quality shadow mask with a high uniformity.

The fourth preferred embodiment of the shadow mask manufacturing method according to the first aspect of the present invention will be described below.

Following the same procedure as in the first preferred embodiment, a resist film with an opening diameter of 100 μm was formed on a surface of a 0.15-mm thick band-like thin metal plate, and a resist film with an opening diameter of 110 μm was formed on the other surface of the thin metal plate.

The band-like thin metal plate on which these resist films were formed was etched by a two-stage etching method. In this fourth preferred embodiment, as in the third preferred embodiment, in the formation of small concave holes in a first etching step, the material was washed with a spray of water as in conventional methods without using any etching inhibiting solution after the small concave holes were formed. After large concave holes were formed in a second etching step, the etching solution was removed and displaced with cold water by using sponge roll brushes. The rest of the etching was done following the same procedure as in the first preferred embodiment.

In this manner, apertures were formed. These apertures consisted of small concave holes with an opening diameter of 140 μm formed in one surface that faces an electron gun and large concave holes with an opening diameter of 275 μm formed in the other surface that faces a phosphor screen. In each of these apertures, the connecting portion formed between the small concave hole and the large concave hole to define the aperture diameter was 15 μm away from the surface in which the small concave holes were formed.

Figure 24:
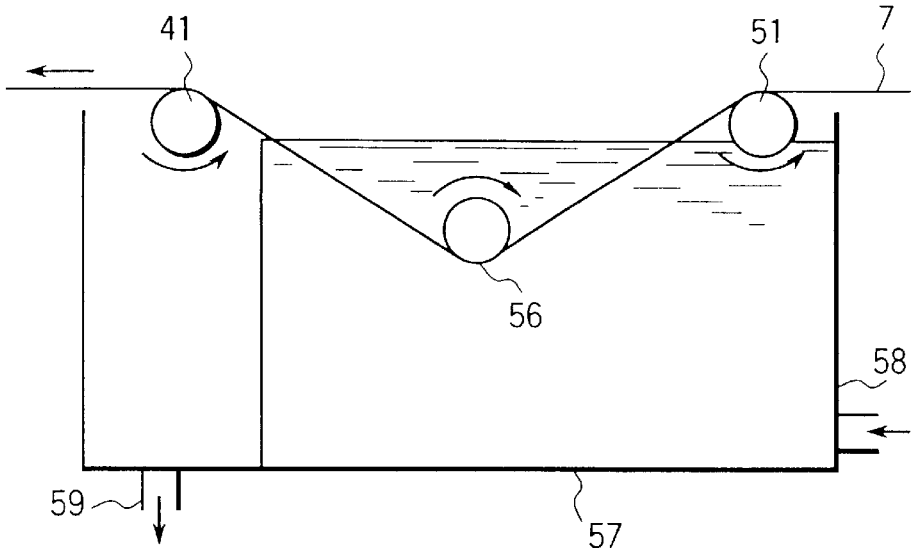
FIG. 24 is a schematic view of an etching solution cleaning device used in the fourth preferred embodiment.

FIG. 24 is a schematic view showing an etching solution displacement device used in the fourth preferred embodiment. This displacement device is used after the second etching step and includes a pair of guide rolls 41 and 51 for guiding a band-like thin metal plate 7 which is conveyed with the surface in which the large concave holes are formed facing down, a sponge roll 56 arranged between these guide rolls 41 and 51, and a cold water tank 57 arranged below the band-like thin metal plate 7. This cold water tank 57 has a cold water injection port 58 and a drainage port 59. A predetermined water level is always held by overflowing cold water injected from the cold water injection port 58. The sponge roll 56 is so formed as to have a diameter of, e.g., about 15 nm and rotated by a driving device (not shown) at the same peripheral speed as the conveyance speed of the band-like thin metal plate 7. The sponge roll 56 is dipped in cold water-in the cold water tank 57 to a depth nearly equal to the radius of the sponge roll 56 from the liquid surface of cold water.

When this etching solution displacement device is used, cold water penetrating into the sponge roll 56 is forcedly supplied into the large concave holes formed in the second etching step because the sponge roll is urged against the band-like thin metal plate 7. Consequently, the etching solution remaining in the large concave holes can be well displaced within a short time period. In this manner, it was possible to suppress variations in the aperture size and shape and obtain a high-quality shadow mask with a high uniformity.

The fifth preferred embodiment according to the first aspect of the present invention will be described below.

First, following the same procedure as in the first embodiment, a resist film with an opening diameter of 100 μm was formed on surface of a 0.15-mm thick band-like thin metal plate, and a resist film with an opening diameter of 110 μm was formed on the other surface of the thin metal plate. The band-like thin metal plate on which these resist films were formed was etched by a two-stage etching method.

In this two-stage etching, in the formation of small concave holes in a first etching step, the material was washed with a spray of water as in conventional methods without displacing an etching solution by using an etching inhibiting solution after the small concave holes were formed. After large concave holes were formed in a second etching step, the etching solution was displaced by a cavitation jet with a water pressure of 5 kg/cm$^2$. The rest of the etching was done following the same procedure as in the first preferred embodiment.

In this manner, apertures were formed. These apertures consisted of small concave holes with an opening diameter of 140 μm formed in one surface that faces an electron gun and large concave holes with an opening diameter of 275 μm formed in the other surface that faces a phosphor screen. In each of these apertures, the connecting portion formed between the small concave hole and the large concave hole to define the aperture diameter was 15 μm away from the surface in which the small concave holes were formed.

Figure 25:
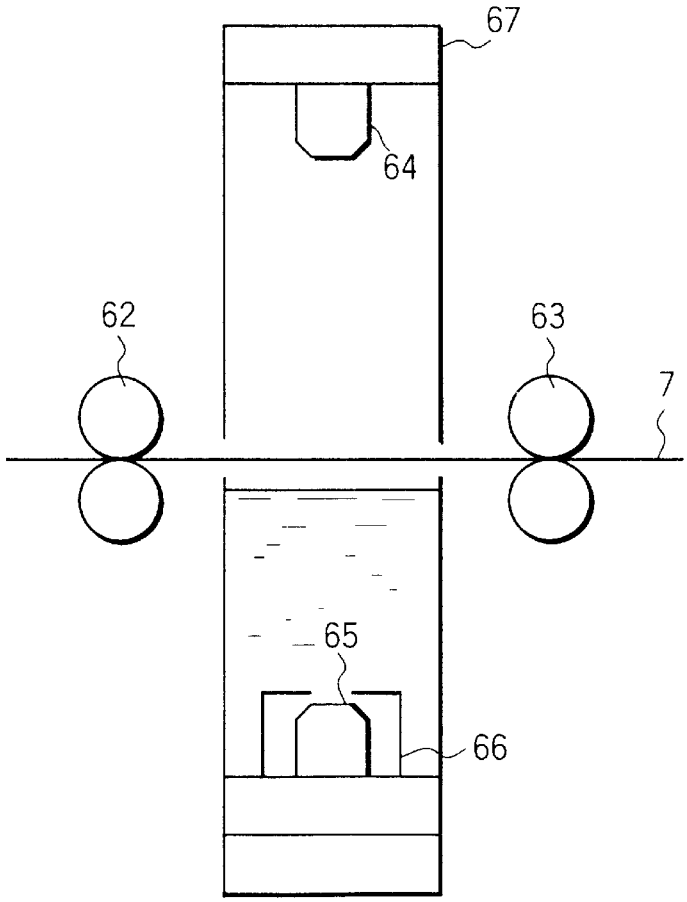
FIG. 25 is a schematic view of an etching solution cleaning device for generating a cavitation jet.

FIG. 25 is a schematic view of an etching solution displacement device for generating a cavitation jet. This displacement device is used after the second etching step and includes pairs of rolls 62 and 63, nozzles 64, nozzles 65, and hollow parts 66. The nozzles 64 are arranged in an upper portion of the displacement device in the widthwise direction of a band-like thin metal plate 7. The nozzles 65 and hollow parts 66 are arranged in a lower portion of the displacement device in the widthwise direction of the band-like thin metal plate 7. The rolls 62 and 63 guide the band-like thin metal plate 7 which is conveyed with the surface in which the large concave holes are formed facing down. The nozzles 64 are arranged between the rolls 62 and 63 and spray cold water at a high pressure as an etching inhibiting solution upon the upper surface of the band-like thin metal plate 7. The nozzles 65 spray cold water at a high pressure upon the lower surface of the band-like thin metal plate 7. The hollow part 66 having aperture disposing on the center axis of the nozzle 65, for forming an air reservour. Description relating to a device for generating a cavitation jet is done later.

In this etching solution displacement device, the cold water sprayed at a high pressure from the nozzles 64 and 65 trap a gas efficiently to generate uniform and fine cavitation, and the etching solution remaining on the upper and lower surfaces of the band-like thin metal plate 7, particularly the etching solution remaining in the concave holes can be efficiently displaced within a short time period. In this manner, it was possible to suppress variations in the aperture size and shape and obtain a high-quality shadow mask with a high uniformity.

The sixth preferred embodiment of the shadow mask manufacturing method according to the first aspect of the present invention will be described below.

As a shadow mask for 37-inch color picture tubes for consumer use, following the same procedure as in the first preferred embodiment, a resist film having 130-μm wide rectangular holes was formed on one surface of a 0.25-mm thick band-like thin metal plate, and a resist film having 480-μm wide rectangular holes was formed on the other side of the band-like thin metal plate.

The thin metal plate on which these resist films were formed was etched by a both-sided simultaneous etching method.

In this sixth preferred embodiment, after the rectangular holes were formed by etching, a cavitation jet was generated by an etching solution displacement device similar to the etching solution displacement device shown in FIG. 25. That is, the etching solution was displaced by spraying a saturated aqueous nickel chloride solution upon the two surfaces of the band-like thin metal plate 7.

In this manner, apertures were formed. These apertures consisted of 220-μm wide rectangular small concave holes formed in one surface on the side of an electron gun and 610-μm wide rectangular large concave holes formed in the other surface on the side of a phosphor screen.

Consequently, a satisfactory etching inhibiting effect was obtained by the etching inhibiting effect of the aqueous nickel chloride solution and the high energy application by the cavitation jet. This suppressed variations in the aperture size and shape, and a high-quality shadow mask with a high uniformity was obtained. In a conventional both-sided simultaneous etching method, spotted patterns were seen when a shadow mask was viewed from the surface in which large concave holes were formed. In this embodiment, however, no such patterns were found.

As the etching inhibiting solution, an aqueous nickel chloride solution was used in the first and sixth embodiments, an aqueous manganese chloride solution was used in the second preferred embodiment, and cold water was used in the third, fourth and fifth embodiments. However, in place of these aqueous nickel chloride solution, aqueous manganese chloride solution, and cold water, it is also possible to use another etching inhibiting solution selected from cold water, alcohol, and a solution containing a metal ion with a higher ionization tendency than that of trivalent iron, such as an aqueous nickel chloride solution, an aqueous cobalt chloride solution, an aqueous potassium chloride solution, an aqueous calcium chloride solution, an aqueous magnesium chloride solution, an aqueous lithium chloride solution, an aqueous zinc chloride solution, an aqueous manganese chloride solution, and an aqueous ferrous chloride solution. Furthermore, nearly similar effects can be obtained even when solution mixtures of two or more solutions selected from these etching inhibiting solutions are used.

The etching solution was displaced by using a megasonic shower in the first preferred embodiment, a slit nozzle shower in the second preferred embodiment, sponge rolls in the third and fourth preferred embodiments, and a cavitation jet in the fifth and sixth preferred embodiments. However, nearly identical effects can be obtained even by using at least one means selected from a cavitation jet, megasonic shower, slit-nozzle shower, and sponge roll, instead of the above displacing means.

Also, conventional spray cleaning requires a comparatively long cleaning time, so a plurality of stages of spray nozzles are arranged along the conveyance direction. Therefore, a large installation space and a large amount of water are necessary. However, the above cleaning means reduces both the installation space and the water amount.

A cleaning device for a thin metal plate according to the second aspect has a cleaning unit for applying a cleaning solution to a band-like thin metal plate, wherein a first leakage-preventing seal unit which is conveyed to the cleaning unit along a longitudinal direction while being held nearly horizontal, is provided upstream the cleaning unit to regulate a position of the band-like thin metal plate, and prevent the cleaning solution from leaking in a direction opposite to the conveyance direction of the band-like thin metal plate, and the cleaning unit comprises cavitation jet means for performing rapid cleaning by spraying the cleaning solution upon the upper and lower surfaces of the band-like thin metal plate and generating cavitation near the surfaces of the thin metal plate.

This cleaning device for a thin metal plate is one example of cleaning devices usable in the cleaning step after the etching step in the shadow mask manufacturing method according to the first aspect. When the device is used in the cleaning step after the etching step, cold water can be preferably used as an etching inhibiting solution.

This cleaning device for a thin metal plate can also be applied to other cleaning steps in the shadow mask manufacturing method, e.g., the cleaning step after the degreasing step and the cleaning step after the development step, as well as to the cleaning step after the etching step. If this is the case, water or cold water can be preferably used as a cleaning solution.

This cleaning device performs cleaning by the action of cavitation while the region to be subjected to rapid solution substitution is regulated by the seal unit. Therefore, a band-like thin metal plate being conveyed can be uniformly cleaned within a short time period.

The cavitation jet means preferably comprises a first spray unit arranged above the thin metal plate and having a plurality of nozzles, for spraying a cleaning solution at a high pressure downward, aligned in a direction substantially perpendicular to the conveyance direction of the thin metal plate, and a second spray unit arranged below the thin metal plate and having a plurality of nozzles, for spraying a cleaning solution at a high pressure upward, aligned in a direction substantially perpendicular to the conveyance direction of the thin metal plate.

The first leakage-preventing seal unit preferably has a pair of pre-stage rollers for clamping the band-like thin metal plate.

This cleaning device can also comprise a second leakage-preventing seal unit provided after the cleaning unit to regulate the position of the band-like thin metal plate and prevent the cleaning solution from leaking in the conveyance direction of the band-like thin metal plate while feeding the band-like thin metal plate.

The second leakage-preventing seal unit preferably has a pair of post-stage rollers for clamping the band-like thin metal plate similar to those of the first leakage-preventing seal unit.

As the inert solution described above, it is possible to use a solution or a solution mixture of two or more solutions selected from water, an aqueous nickel chloride solution, an aqueous manganese chloride solution, an aqueous ferrous chloride solution, and alcohol. More preferably, water is used.

A preferred embodiment of the cleaning device for a thin metal plate according to the second aspect of the present invention will be described below with reference to the accompanying drawings.

Figure 26:
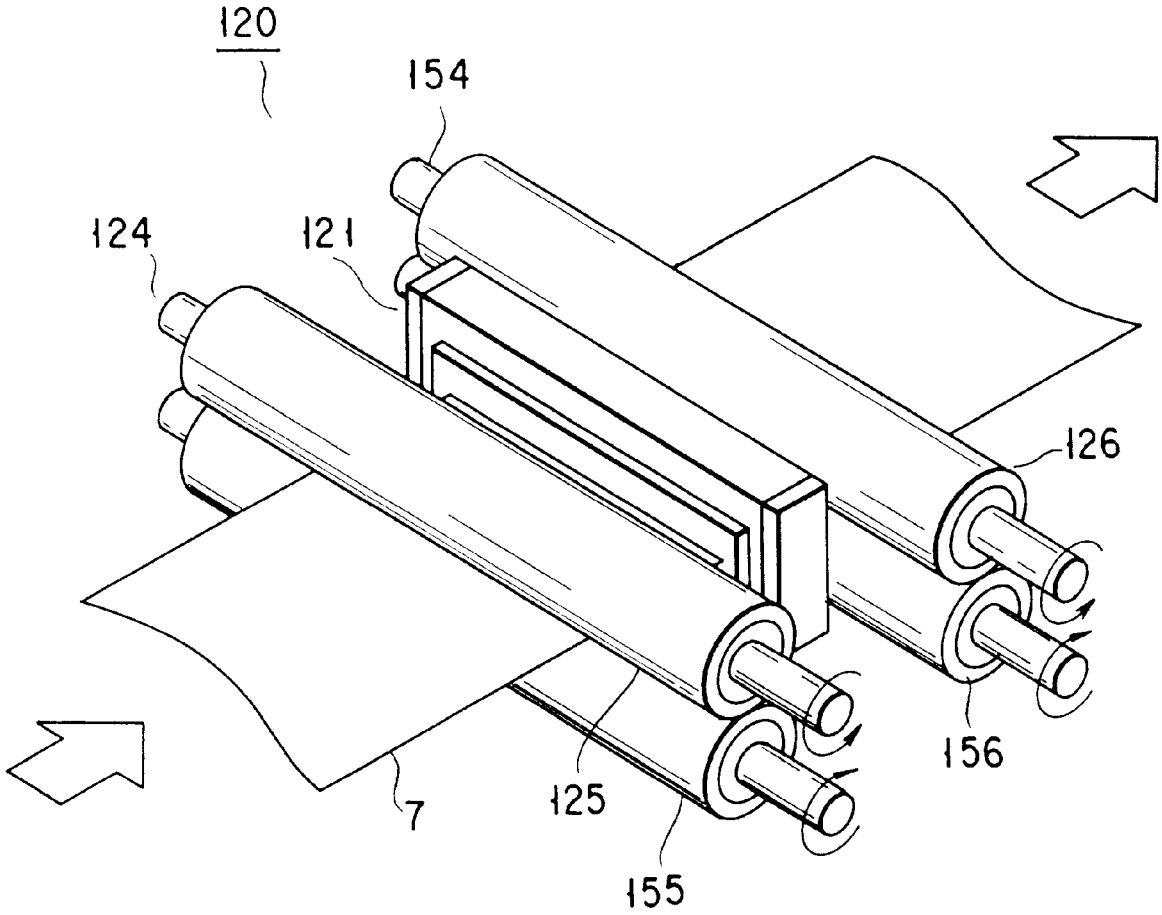
FIG. 26 is a perspective view showing a preferred embodiment of a cleaning device for a thin metal plate according to the second aspect of the present invention.
Figure 28:
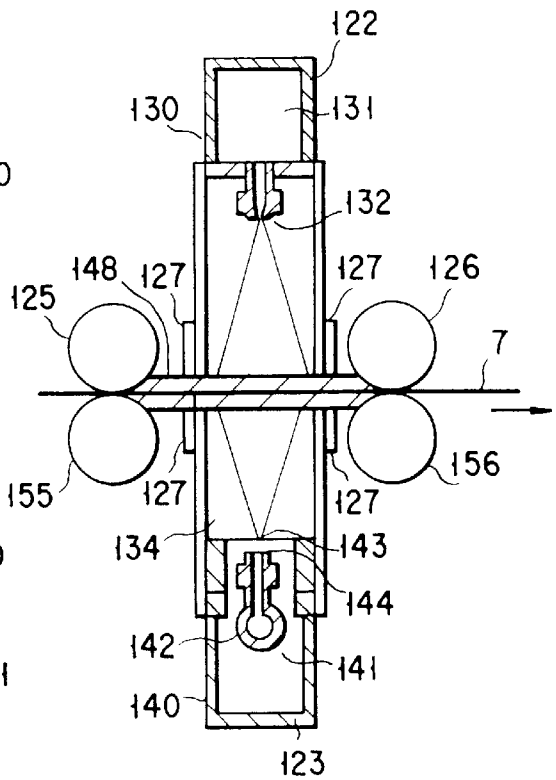
FIG. 28 is a view showing a longitudinal sectional structure, which is parallel to the conveyance direction of a thin metal plate, of the cleaning device for a thin metal plate.
Figure 27:
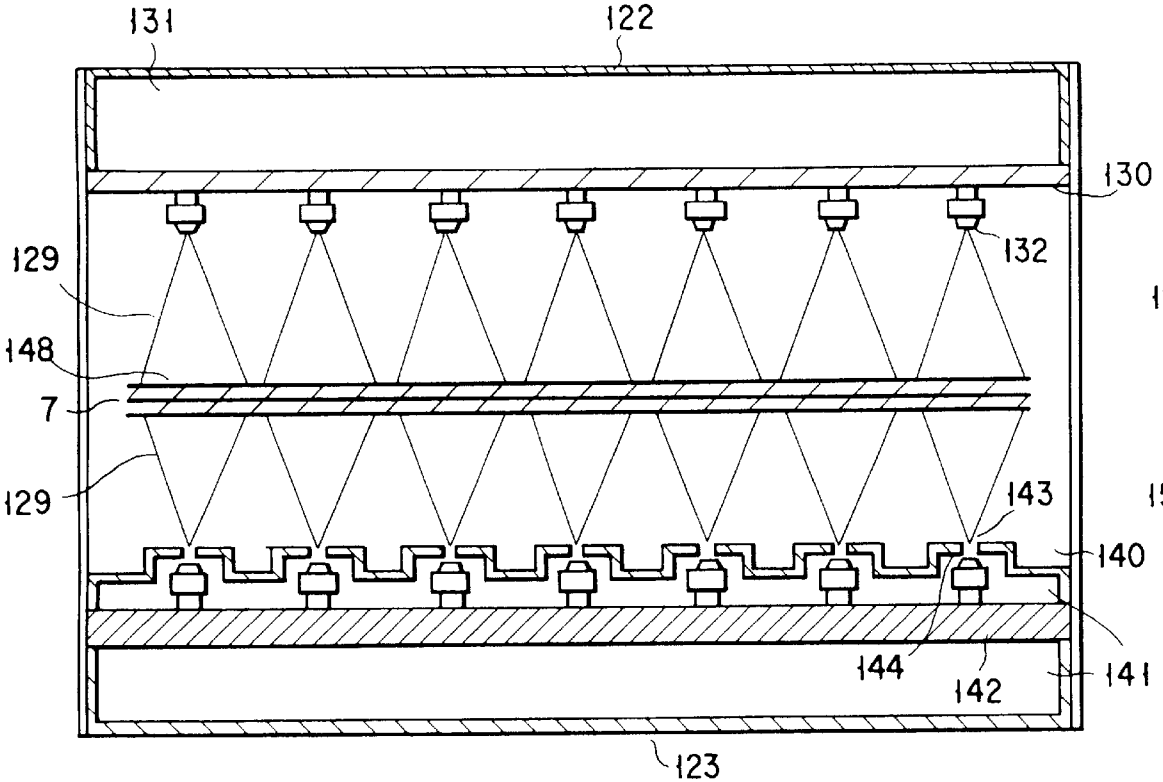
FIG. 27 is a view showing a longitudinal sectional structure, which is perpendicular to the conveyance direction of a thin metal plate, of the cleaning device for a thin metal plate.

FIG. 26 is a perspective view showing the preferred embodiment of the cleaning device for a thin metal plate according to the second aspect of the present invention. FIG. 27 shows a longitudinal sectional structure, which is perpendicular to the conveyance direction of a thin metal plate, of the cleaning device for a thin metal plate. FIG. 28 shows a longitudinal sectional structure, which is parallel to the conveyance direction of a thin metal plate, of the cleaning device for a thin metal plate.

The shadow mask cleaning device of the present invention generates cavitation consisting of fine uniform bubbles near the surfaces of a thin metal plate by spraying a cleaning solution which is inert with respect to the thin metal plate. By using this cavitation, the device rapidly cleans up and displaces substances sticking to the thin metal plate with the cleaning solution.

As shown in FIG. 26, this cleaning device 120 comprises a cleaning unit 121 for rapidly performing cleaning by generating cavitation and seal units 124 and 154. As shown in FIGS. 27 and 28, the cleaning unit 121 is so arranged that an upper cleaning unit 122 and a lower cleaning unit 123 oppose each other on the both sides of a band-like thin metal plate 7. Also, the pre-stage seal unit 124 and the post-stage seal unit 154 are positioned on the both sides of the cleaning unit 122 along the conveyance direction (indicated by the arrow in FIG. 28) of the thin metal plate 7. The pre- and post-stage seal units 124 and 154 consist of a pair of rollers 125 and 155 and a pair of rollers 126 and 156, respectively, made from neoprene rubber and so arranged as to clamp the thin metal plate.

The seal units 124 and 154 are arranged at the two ends of a region where rapid cleaning is performed by generating cavitation. The purposes of these seal units 124 and 154 are to i) form a solution reservoir above a thin metal plate, ii) prevent fluttering of a thin metal plate caused by generation of cavitation, and iii) prevent a solution from leaking or splashing to the outside of the cavitation generation region. Especially when the device is used in cleaning after the etching step, the purpose iii) is regarded as important because there is a possibility that the etching solution sticking to a thin metal plate is activated and etching again proceeds. For this purpose, the pre-stage seal unit 124 is desirably as close as possible to the cleaning unit 121. Of the etching inhibiting solution flowing forward and backward from this cleaning device 120 along the conveyance direction of the thin metal plate 7, the etching inhibiting solution flowing forward from the cleaning device 120 dilutes the etching solution remaining on the thin metal plate 7 before cleaning and increases the etching rate of the etching solution. As the distance between the cleaning unit 121 and the prestage seal unit 124 increases, the region in which the etching solution on the thin metal plate 7 before cleaning is diluted widens. This results in further etching.

To prevent a solution leakage without disturbing conveyance of a thin metal plate, it is desirable to use rollers in the seal unit. Although the use of an air knife can also provide a seal, an air knife has a drawback of complicating the structure. To decrease the distance to the cleaning unit 121, it is considered desirable to decrease the roller diameter. However, the roller diameter preferably has a certain large value to prevent splash of a solution. Also, the weight of the upper roller is preferably heavy to prevent a solution leakage. However, if the weight is too heavy, rotation of the roller is interfered with, and this may cause damages to the thin metal plate. This can be prevented by providing a drive to the roller and synchronizing rotation of the roller with feeding of the thin metal plate. The roller diameter and the roller weight can be appropriately determined by taking account of the above conditions.

As shown in FIGS. 27 and 28, the cleaning unit 121 consists of the upper solution cleaning unit 122 and the lower solution cleaning unit 123 opposing each other on the two sides of the thin metal plate 7. The upper solution cleaning unit 122 has a first spray unit 130 in which a plurality of spray nozzles 132 are arranged downward to be substantially perpendicular to the conveyance direction. The first spray unit 130 sprays an inert solution 129 at a high pressure upon the upper surface of the band-like thin metal plate 7. The lower solution cleaning unit 123 has a solution tank 134 and a second spray unit 140 provided below the solution tank 134 and having a plurality of spray nozzles 144 arranged upward to be substantially perpendicular to the conveyance direction. The second spray unit 140 sprays the inert solution 129 at a high pressure upon the lower surface of the band-like thin metal plate 7.

The first spray unit 130 has a structure in which a larger number of spray nozzles 132 are arranged on the lower side of a hollow member 131. When high pressure water is supplied into this hollow member 131, the high-pressure solution 129 sprayed from the spray nozzles 132 entraps air near the surface of a solution 148 remaining on the upper surface of the thin metal plate 7. This allows uniform and fine cavitation to be generated.

The second spray unit 140 also has a hollow member 141. In this hollow member 141, a large number of spray nozzles 144 project upward, and a larger number of holes 143 are formed in a one-to-one correspondence with these spray nozzles 144. Air is supplied into the hollow member 141. High-pressure water is supplied to a pipe 142, and the spray nozzles 144 spray this high-pressure water. When sprayed, the high-pressure water entraps air at the holes in the second spray unit 140, generating cavitation toward the lower surface of the thin metal plate.

Variable slits 127 are also formed before and after the cleaning unit to regulate the amount of reserved solution.

In this cleaning device as described above, high-pressure water efficiently entraps air to generate uniform and fine cavitation. Therefore, the device can rapidly and uniformly perform removal of substances sticking to the thin metal plate and cleaning and displacement by the cleaning solution on the upper and lower surfaces of the thin metal plate. Also, since the device includes the seal units, cleaning and displacement by the cleaning solution can be uniformly performed within the range defined by the seal units. In particular, although concave portions are formed in the thin metal plate after etching, a solution which is inert with respect to the thin metal plate enters these concave portions by the use of cavitation. This makes rapid and efficient cleaning feasible.

Additionally, if the resist thickness is decreased, overhanging portions of the resist formed after etching can also be destroyed by the action of cavitation. This further increases the displacement efficiency of the cleaning solution.

In conventional spray cleaning process, cleaning condition under 2 kg/cm$^2$ of water pressure, 150 L/min flow rate for at least 30 seconds was required. However in the cleaning process according to the present invention cleaning condition can be under 5 to 7.5 kg/cm$^2$ of water pressure, 50 L/min of flow rate for about 10 seconds.

As described above, conventional spray cleaning requires a relatively long cleaning time, so a plurality of stages of spray nozzles are arranged along the conveyance direction. Therefore, a large installation space and a large amount of water are necessary. The cleaning device of the present invention can reduce both the installation space and the water amount by one-half.

The cleaning device of the present invention can be used in the thin metal plate cleaning steps in the shadow mask manufacturing process, e.g., the cleaning step after the etching step and the cleaning step after the resist stripping step.

Also, in a shadow mask manufacturing apparatus, the cleaning device of the present invention can be used as a means for removing and displacing an etching solution sticking to a thin metal plate after etching.

The third aspect provides a shadow mask manufacturing apparatus in which the cleaning device for a thin metal plate according to the second aspect is applied after the etching step.

This shadow mask manufacturing apparatus comprises, an etching unit for etching a band-like thin metal plate on both surfaces of which etching protective layers each having a pattern corresponding to apertures of a shadow mask on at least one surface thereof are formed, an etching protective layer stripping unit for stripping the etching protective layers, and a cleaning device for cleaning the band-like thin metal plate, by using a cleaning solution, wherein the cleaning device comprises a first leakage-preventing seal unit for regulating the position of the band-like thin metal plate, which is conveyed to a cleaning unit along the longitudinal direction while being held nearly horizontal, and preventing the cleaning solution from leaking in a direction opposite to the conveyance direction of the band-like thin metal plate, and a cavitation jet means provided in the first leakage-preventing seal unit to perform rapid cleaning by spraying a cleaning solution, which is inert with respect to the band-like thin metal plate, upon upper and lower surfaces of the band-like thin metal plate and thereby generating cavitation near the surfaces of the thin metal plate.

In this apparatus, the etching solution remaining in apertures or concave holes formed by etching can be well displaced with an etching inhibiting solution within a short time period. Also, the time during which the material is in contact with the dilute etching solution with a high etching rate is shortened. This suppresses changes in the aperture size and variations in the aperture size and shape, so a shadow mask with a high uniformity can be manufactured. Additionally, even when the apparatus is used in cleaning after steps except etching, cleaning can be rapidly and efficiently performed by the use of cavitation.

The present invention is applicable to either a simultaneous etching method in which apertures are formed by a both-sided simultaneously etching method in which both surfaces of a thin metal plate are subject to etching simultaneously, or a two-stage etching method in which apertures are formed by separately etching each surfaces in two stages. Especially in cleaning after etching, a ferric chloride etching solution remaining on a thin metal plate can be displaced, as soon as possible, by using an etching inhibiting solution which is inert with respect to the thin metal plate. As this etching inhibiting solution, it is preferable to use a solution or a solution mixture of two or more solutions selected from cold water, an aqueous nickel chloride solution, an aqueous manganese chloride solution, an aqueous ferrous chloride solution, and alcohol.

When a nickel chloride solution or a manganese chloride solution is used, rinsing using water is further required after displacement is performed by using this etching inhibiting solution, and this complicates the process. As can be seen from FIG. 11, water at a low temperature is effective even though water is inferior to a nickel chloride or manganese chloride solution in the inhibitory effect. The temperature of the etching solution is usually 50° C. to 70° C. Therefore, even water at a room temperature of 20° C. to 25° C., preferably cold water at 5 to 20° C. can lower the temperature of the etching solution, decrease the reaction rate of the etching solution, and efficiently perform displacement within a short time period. Since this shortens the time of contact with the etching solution, re-etching by a dilute etching solution with a high etching rate can be prevented.

Furthermore, when the cleaning step done by the cleaning device of the present invention, in which uniform and fine cavitation is generated by efficiently trapping air by a cleaning solution and cleaning and displacement by the cleaning solution are performed, is used in a cleaning step after etching in a shadow mask manufacturing method, it is possible to provide a shadow mask free of variations in the aperture size and shape and having a high uniformity.

A shadow mask manufacturing method according to the fourth aspect of the present invention comprises the step of etching a band-like thin metal plate on both surfaces of which etching protective layers each having a pattern corresponding to apertures of a shadow mask on at least one surface thereof are formed, the etching protective layer stripping step of stripping the etching protective layers, and the step of performing rapid cleaning by spraying a cleaning solution, which is inert with respect to the band-like thin metal plate, upon upper and lower surfaces of the band-like thin metal plate by using cavitation jet means and thereby generating cavitation near the surfaces of the band-like thin metal plate, while regulating a position of the band-like thin metal plate and preventing the cleaning solution from leaking in a direction opposite to the conveyance direction of the band-like thin metal plate by using a first leakage-preventing seal unit provided before the cavitation jet means.

The first preferred embodiment of the shadow mask manufacturing method according to the fourth aspect which uses the cleaning device for a thin metal plate according to the second aspect and the shadow mask manufacturing apparatus according to the third aspect will be described below.

Figure 29:
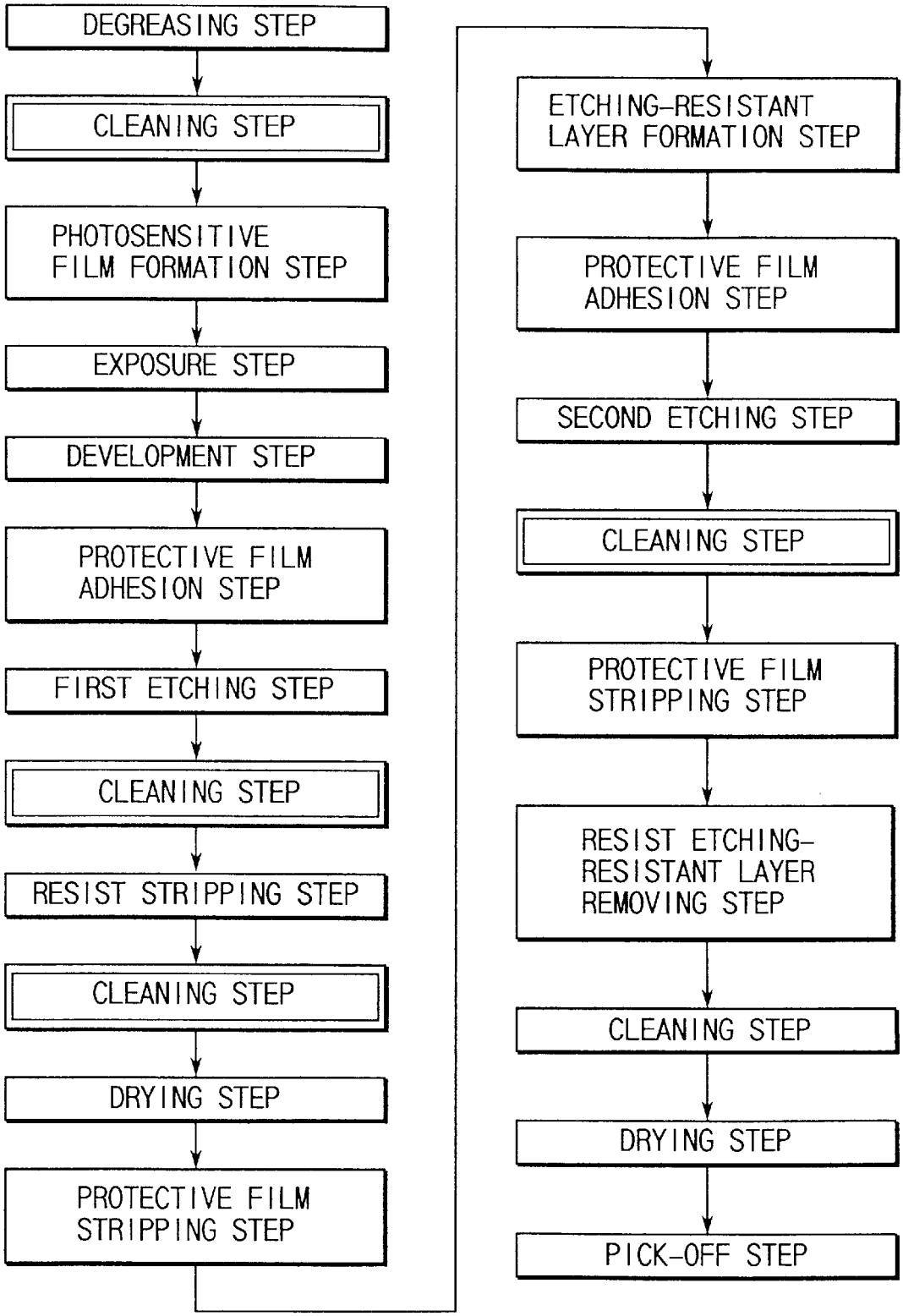
FIG. 29 is a flow chart showing the individual steps of a two-stage etching method.

In this embodiment, a method of forming apertures by a two-stage etching method by using a thin metal plate made from a 0.12-mm thick invar material as a shadow mask substrate will be described with reference to FIGS. 12 to 20 and 26 to 28. To allow easy understanding of the shadow mask manufacturing steps, FIG. 29 shows a flow chart indicating the individual steps of the two-stage etching method. In each cleaning step enclosed within a double frame, the cleaning device according to the second aspect of the present invention is used.

Degreasing step

First, rolling oil and rust preventing oil sticking to the surfaces of a band-like thin metal plate were removed by spraying an alkali degreasing solution.

Cleaning step

Thereafter, the cleaning device shown in FIGS. 26 to 28 was used to spray 25° C. industrial water at a hydraulic pressure of 5 to 15 kg/cm$^2$, an air pressure of 5 kg/cm$^2$, and an air flow rate of 0.2 Nm/min, thereby washing the thin metal plate with the water.

Photosensitive film formation step

The resultant thin metal plate was dried, and, as shown in FIG. 12, the two surfaces of the thin metal plate 7 were coated with a photosensitive material primarily consisting of casein and dichromate. The photosensitive material was dried to form photosensitive films 8 with a thickness of a few $\mu$m.

Figure 30:
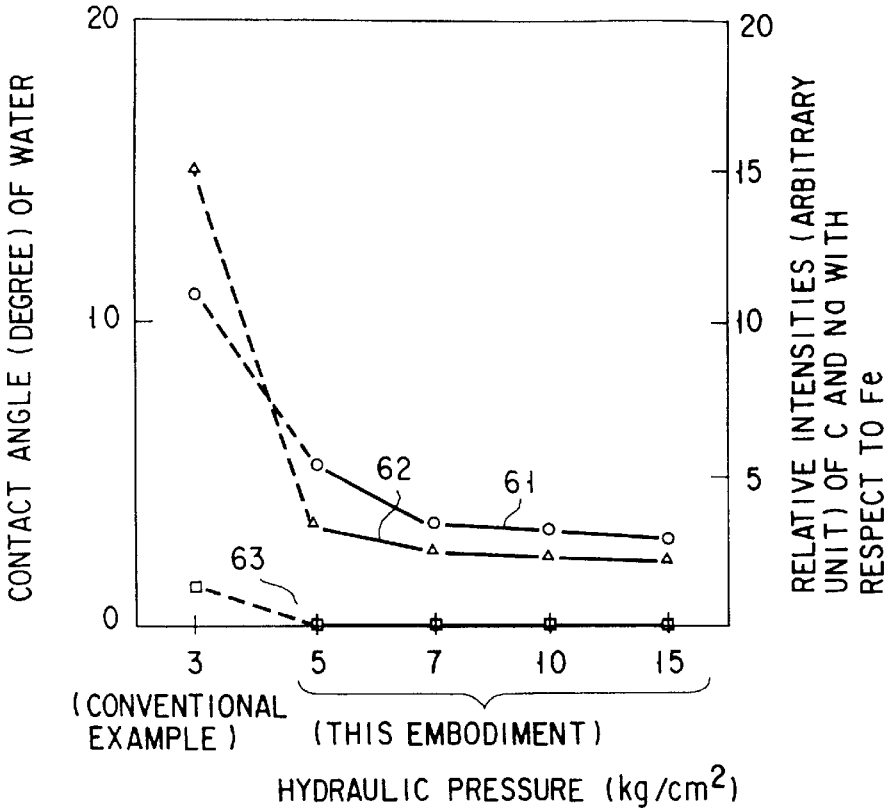
FIG. 30 is a graph showing the cleanness of a thin metal plate which is degreased and washed with water.

The cleanness of the thin metal plate degreased and washed with water was checked by the contact angle of waterdrops and elemental analysis using XPS (X-ray photoelectric spectroscopy). The results are shown in FIG. 30. FIG. 30 is a graph in which a curve 61 represents the relationship between the hydraulic pressure during cleaning and the surface contact angle of water, and curves 62 and 63 represent the relative values of the peak intensities of C and Na with respect to the peak intensity of Fe, i.e., C/Fe and Na/Fe, respectively, when the hydraulic pressure during cleaning was changed. C/Fe indicates the degree of removal of the oil component and the chelating agent component in the degreasing agent. Na/Fe indicates the degree of removal of the degreasing agent. As shown in FIG. 30, the cleanness of the thin metal plate in this embodiment was greatly improved compared to that when cleaning was performed by a conventional method within the range of a hydraulic pressure of 5 to 15 kg/cm$^2$.

Exposure step

Subsequently, as shown in FIG. 13, a pair of masters 9 and 19 were prepared. The master 9 had a dot pattern corresponding to small apertures formed in a surface of a shadow mask on the side of an electron gun. The master 19 had a dot pattern corresponding to large apertures formed in a surface of a shadow mask on the side of a phosphor screen. These masters 9 and 19 were adhered to the photosensitive films 8 on the two surfaces of the thin metal plate 7 and exposed to transfer the patterns of the masters 9 and 19 onto the photosensitive films 8.

Development step

The photosensitive films 8 on the two surfaces of which the patterns were transferred were developed to remove unexposed portions. Consequently, as shown in FIG. 14, resist films 10 and 30 as etching protective layers having patterns corresponding to the patterns of the pair of masters 9 and 19 described above were formed.

Protective film adhesion step

The band-like thin metal plate on which the resist films were thus formed was once wound into a roll and moved to the subsequent step in the form of the roll. The subsequent step was performed by unrolling the roll band-like thin metal plate on which the resists were formed by using a conveyor apparatus.

As shown in FIG. 15, a protective film 31 made from, e.g., a polyethyleneterephthalate (PET) resin was adhered to the surface on which the resist 30 was formed.

First etching step

A ferric chloride etching solution at a temperature of 70° C. and having a specific gravity of 1.510 was sprayed by an etching device upon the surface on which the resist 10 was formed. Consequently, small concave holes 12 for forming small apertures in a shadow mask on the side of an electron gun were formed in the surface on which the resist film 10 was formed.

Cleaning step

After the first etching step, the device shown in FIGS. 26 to 28 was used to spray, as an inert etching inhibiting solution, 25° C. industrial water at a hydraulic pressure of 5 to 15 kg/cm$^2$ an air pressure of 5 kg/cm$^2$, and an air flow rate of 0.2 Nm/min, thereby washing the thin metal plate with the water. Consequently, an etching solution 24 remaining on the surface of the thin metal plate, particularly in the small concave holes 12 was rapidly displaced with the industrial water. That is, as shown in FIG. 16, the etching solution remaining on the surface of the thin metal plate 7, particularly in the small concave holes 12 was removed.

More specifically, when the concave holes 12 are formed by etching as described above, the opening diameters of these concave holes 12 are larger than the opening diameters of the resist 10 due to progress of side-etching. Consequently, overhanging portions of the resist 10 are formed, and a relatively large amount of etching solution 16 remains inside the overhanging portions. Spray washing conventionally performed after etching cannot rapidly dilute and remove the etching solution remaining inside the overhanging portions. Therefore, the material is exposed to a dilute etching solution with a high etching rate for a long time period, resulting in variations in the aperture size and shape. However, when the device shown in FIGS. 27 and 28 is used as in this embodiment, the etching solution remaining on the thin metal plate can be well removed within a short time period. Consequently, it is possible to suppress variations in the aperture size and shape caused by the dilute etching solution.

Resist film stripping step

Subsequently, the resultant material was passed through a resist film stripping device to strip off the resist film 10 on the surface in which the small concave holes 12 were formed.

Cleaning step

The device shown in FIGS. 26 to 28 was used to spray 25° C. industrial water at a hydraulic pressure of 5 to 15 kg/cm$^2$, an air pressure of 5 kg/cm$^2$, and an air flow rate of 0.2 Nm/min, thereby washing the thin metal plate with the water.

Drying step

Thereafter, the thin metal plate was dried.

Protective film stripping step

The protective film 31 adhered on the surface of which the resist 30 was formed was removed.

Etching-resistant layer formation step

Thereafter, as shown in FIG. 17, the surface in which the small concave holes were formed and the interiors of these small concave holes were coated and filled with an etching-resistant UV-curing resin, and the resin was cured by a curing device using a high-pressure mercury lamp, thereby forming an etching-resistant layer 13.

Protective film adhesion step

A protective film 11 made from, e.g., a PET resin was adhered to this etching-resistant layer 13.

Figure 31:
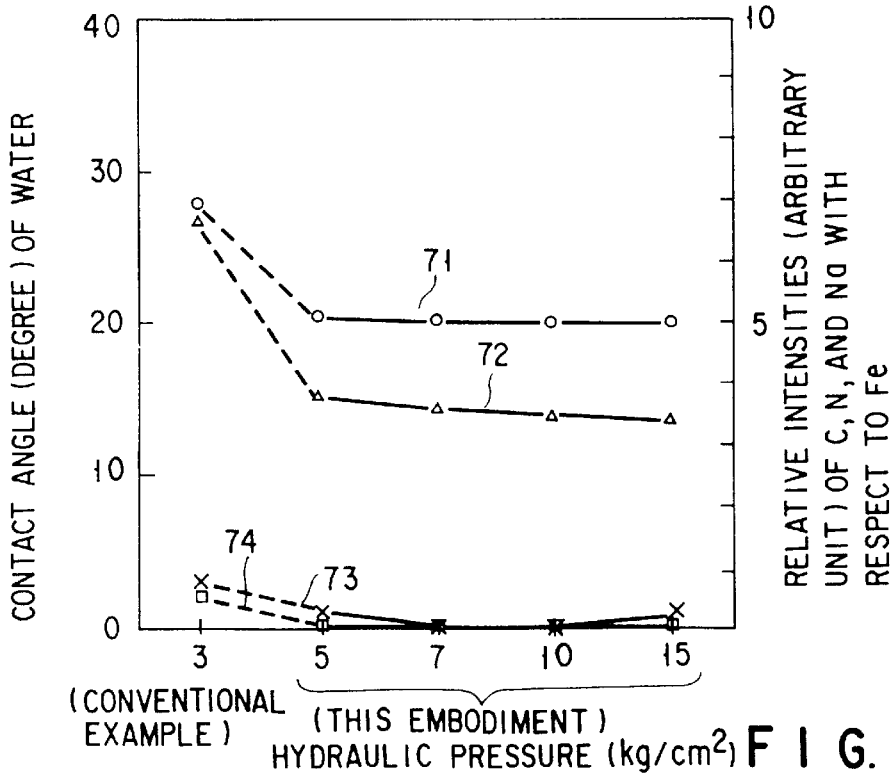
FIG. 31 is a graph showing the cleanness of the thin metal plate washed with water after the resist film is stripped.

The cleanness of the thin metal plate washed with water after the resist film was stripped was checked by the contact angle of waterdrops and elemental analysis using XPS (X-ray photoelectric spectroscopy). The results are shown in FIG. 31. FIG. 31 is a graph in which a curve 71 represents the relationship between the hydraulic pressure during cleaning and the surface contact angle of water, and curves 72, 73, and 74 represent the relative values of the peak intensities of C, N, and Na with respect to the peak intensity of Fe, i.e., C/Fe, N/Fe, and Na/Fe, respectively, when the hydraulic pressure during cleaning was changed. C/Fe and N/Fe indicate the degrees of removal of the resist components. Na/Fe indicates the degree of removal of the stripping solution component. As shown in FIG. 31, the cleanness of the thin metal plate in this embodiment was greatly improved compared to that when cleaning was performed by a conventional method within the range of a hydraulic pressure of 5 to 15 kg/cm$^2$, particularly 7 to 10 kg/cm$^2$.

Second etching step

Thereafter, as shown in FIG. 18, a ferric chloride etching solution at a temperature of 70° C. and having a specific gravity of 1.510 was sprayed upon the surface on which the resist 30 was formed. Consequently, large concave holes 32 for forming large apertures in a shadow mask on the side of a phosphor screen were formed in the surface on which the resist 30 was formed.

Cleaning step

After this second etching step, as when the first etching step was completed, the device shown in FIGS. 26 to 28 was used to remove the etching solution remaining in the large concave holes 32 as shown in FIG. 19.

Protective film stripping step

Thereafter, the protective film 11 adhered on the other surface was removed.

Resist/etching-resistant layer stripping step

The resist 30 in the surface of which the large concave holes 32 were formed and the etching-resistant layer 13 in the surface of which the small concave holes 12 were formed were stripped off by using an aqueous alkali solution.

Cleaning step and drying step

The resultant material was further washed water and dried to form apertures 14 in each of which the small concave hole 12 and the large concave hole 32 communicated with each other as shown in FIG. 20.

Pick-off step

Thereafter, a shadow mask in which the apertures were formed was cut off from the band-like thin metal plate to complete a flat mask.

Figure 32:
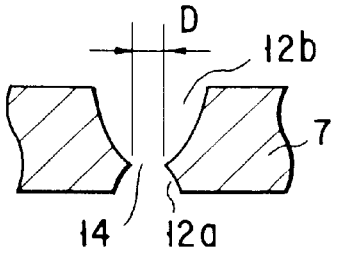
FIG. 32 is a sectional view for explaining a connecting portion in an aperture.
Figure 33:
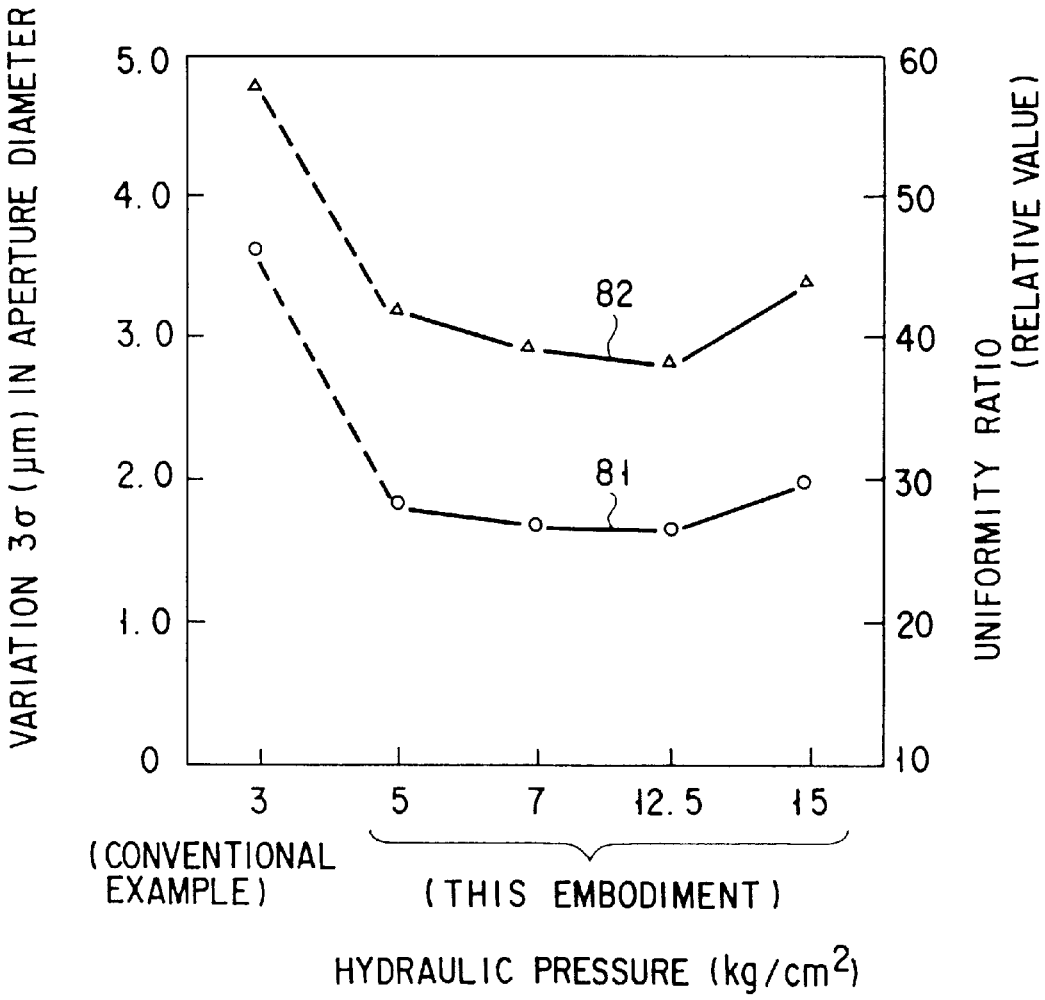
FIG. 33 is a graph showing the relationship between the hydraulic pressure when the shadow mask is cleaned, the variation $3\sigma$ in the aperture diameter D, and the uniformity.

Shadow masks were manufactured by the above manufacturing method by setting an aperture diameter D, which was defined by the connecting portion between the small hole 12 and the large hole 32, to 115 $\mu$m, and a variation 3$\sigma$ in the aperture diameter D and the uniformity were measured. FIG. 32 is a schematic view for explaining the connecting portion in the aperture. Also, FIG. 33 is a graph showing the relationship between the hydraulic pressure during cleaning and the variation 3$\sigma$ in the aperture diameter, the relationship between the hydraulic pressure during cleaning and the uniformity, and the variation 3$\sigma$ and the uniformity of shadow masks manufactured by a conventional method. In this comparison, the hydraulic pressure of the shadow mask cleaning device of the present invention was 7 kg/cm$^2$ in the photosensitive film formation step and the etching-resistant layer formation step, and 7.5 kg/cm$^2$ in the removal of the residual etching solution after etching. Referring to FIG. 33, a curve 81 represents the variation 3$\sigma$ in the aperture diameter D obtained by measuring the shadow mask aperture diameter D at 100 points by using a measuring device, and a curve 82 represents the uniformity measured by placing the shadow mask on a light box using fluorescent lamps at a color temperature of 5700 K and using a uniformity inspection device manufactured by Seika Sangyo K.K. The uniformity is indicated by the uniformity ratio. This uniformity ratio is a relative value; the larger the value the lower the uniformity level. As shown in FIG. 33, variations in the aperture diameter D of the shadow masks manufactured by the method of this embodiment were small, indicating that the uniformity was greatly improved.

As is apparent from the comparisons shown in FIGS. 30, 31, and 33, even when the hydraulic pressure was raised in the conventional washing method, only the use amount of water increased, and no such effect as in the present invention could be obtained.

The second preferred embodiment of the present invention according to the second to fourth aspects of the present invention will be described below.

In the above first embodiment, the method of forming apertures in a shadow mask by using a two-stage etching process has been explained. However, the method of the present invention is also applicable to a process in which apertures are formed by simultaneously etching the two surfaces of a thin metal plate. FIGS. 34 to 39 are views for explaining steps of forming apertures by simultaneously etching the both surfaces of a thin metal plate. A nearly similar preferable effect to that described above can be obtained by this method.

In the second preferred embodiment, a method of manufacturing a shadow mask with rectangular apertures for large color picture tubes for consumer use by using a 0.25-mm thick invar material will be described below.

Cleaning step

First, rolling oil and rust preventing oil sticking to the surfaces of a band-like thin metal plate were removed by spraying an alkali degreasing solution. Thereafter, the cleaning device shown in FIGS. 26 to 28 was used to spray 25° C. industrial water at a hydraulic pressure of 10 kg/cm$^2$, an air pressure of 5 kg/cm$^2$, and an air flow rate of 0.2 Nm/min, thereby washing the thin metal plate with the water.

Photosensitive film formation step

Figure 34:
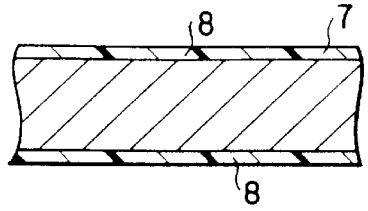
FIGS. 34 to 39 are sectional views for explaining steps of forming apertures by simultaneously etching the two surfaces of a thin metal plate.

The resultant thin metal plate was dried, and, as shown in FIG. 34, the both surfaces of the thin metal plate 7 were coated with a photosensitive material primarily consisting of casein and dichromate. The photosensitive material was dried to form photosensitive films 8 with a thickness of a few $\mu$m.

Exposure step

Figure 35:
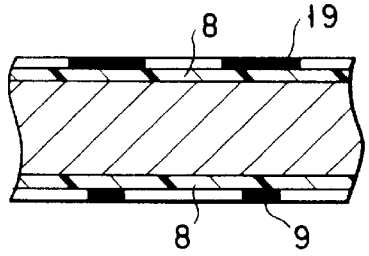

Subsequently, as shown in FIG. 35, a pair of masters 9 and 19 were prepared. The master 9 had a pattern corresponding to small apertures in a shadow mask on the side of an electron gun. The master 19 had a pattern corresponding to large apertures formed in a shadow mask on the side of a phosphor screen. These masters 9 and 19 were adhered to the photosensitive films 8 on the two surfaces and exposed to transfer the patterns of the masters 9 and 19 onto the photosensitive films 8.

Development step

Figure 36:
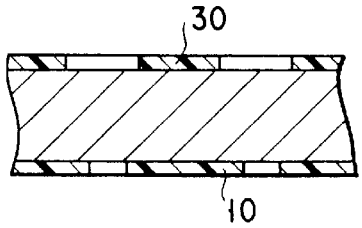

The photosensitive films 8 on the both surfaces of which the patterns were transferred were developed to remove unexposed portions. Consequently, as shown in FIG. 36, resists 10 and 30 having patterns corresponding to the patterns of the pair of masters 9 and 19 described above were formed. The band-like thin metal plate on which the resists were thus formed was once wound into a roll and moved to the subsequent etching step in the form of the roll.

Etching step

This step was performed by unrolling the roll band-like thin metal plate on which the resists were formed by using a conveyor apparatus.

Figure 37:
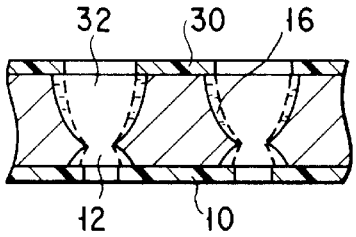

First, as shown in FIG. 37, a ferric chloride etching solution at a temperature of 70° C. and having a specific gravity of 1.510 was sprayed upon the two surfaces on which the resists 10 and 30 were formed by passing the material through an etching device. Consequently, small concave holes 12 for forming small apertures in a shadow mask on the side of an electron gun were formed in the surface on which the resist 10 was formed, and large concave holes 32 for forming large apertures in a shadow mask on the side of a phosphor screen were formed on the surface of which the resist 30 was formed.

Cleaning step

Figure 38:
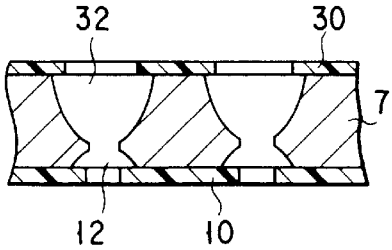
Figure 39:
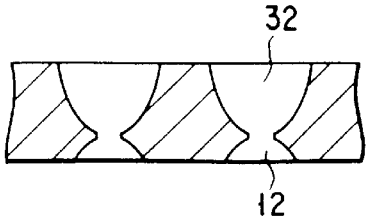

After this etching step, the device shown in FIGS. 26 to 28 was used to spray 25° C. industrial water at a hydraulic pressure of 10 kg/cm$^2$, an air pressure of 5 kg/cm$^2$, and an air flow rate of 0.2 Nm/min directly upon the both surfaces of the thin metal plate 7. Consequently, an etching solution 16 remaining on the surfaces of the thin metal plate 7, particularly, as shown in FIG. 38, in the connecting portions between the small holes 12 and the large holes 32 was rapidly displaced with the industrial water.

Pick-off step

Thereafter, the resultant material was passed through a resist stripping device to strip off the resists 10 and 30 by using an aqueous alkali solution, washed with water, and dried. A shadow mask in which the apertures were formed was cut off from the band-like thin metal plate to complete a flat mask.

In the shadow mask obtained by the second preferred embodiment described above, variations in the aperture size and shape were suppressed and the uniformity was improved, as in the shadow mask obtained by the first preferred embodiment. Also, when conventional washing was used, stain-like uneven reflection caused by the non-uniformity of wash water was found. In contrast, when the cleaning methods used in the present invention according to the second to fourth aspects were used, no such stain-like uneven reflection was found.

Note that the cleaning step using the cleaning device according to the second aspect of the present so invention is not limited to the above preferred embodiments and can be used in an arbitrary cleaning step. It is particularly effective to use this cleaning step as a cleaning step after etching.

Figure 40:
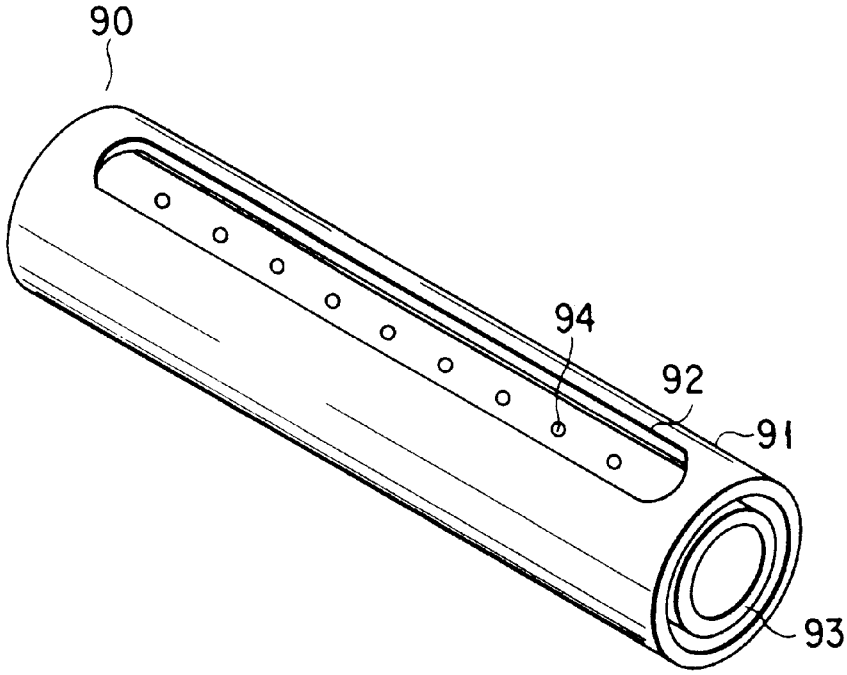
FIG. 40 is a perspective view of another example of a second spray unit.
Figure 41:
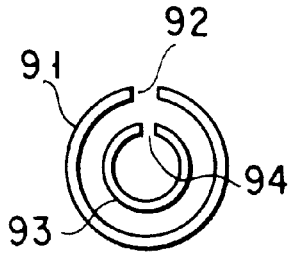
FIG. 41 is a schematic view for explaining the structure of a spray nozzle shown in FIG. 40.

Note also that the second spray unit 40 of the cleaning device according to the second aspect of the present invention is not limited to the structure described previously. FIG. 40 is a perspective view of another example of the second spray unit. FIG. 41 is a schematic view for explaining the structure of a spray nozzle. As shown in FIGS. 40 and 41, an inner cylinder 93 having a plurality of spray nozzle holes 94 is assembled inside an outer cylinder 91 having an elongated hole 92 along the axial direction. High-pressure water is supplied to the inner cylinder 93, and air is supplied to the outer cylinder 91.

Even when this spray unit is used as the second spray unit, it is possible to generate uniform and fine cavitation near the upper and lower surfaces of a band-like thin metal plate and perform sufficient cleaning within a short time period with a high efficiency. Since this suppresses variations in the aperture size and shape, a shadow mask with a high uniformity can be manufactured.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A shadow mask manufacturing method comprising the steps of:

forming etching protective layers on both sides of a thin metal plate, where each protective layer has a pattern corresponding to apertures to be formed in the thin metal plate;

etching the thin metal plate on which the etching protective layers are formed by using an etching solution containing ferric chloride; and cleaning the thin metal plate by removing the etching solution residue after the etching step by displacing the etching solution with an etching inhibiting solution which is inert with respect to the thin metal plate, and which comprises a solution containing a metal ion having an ionization tendency higher than an ionization tendency of trivalent iron.

2. A method according to claim 1, wherein the thin metal plate has a shape of a band and is conveyed along a longitudinal direction while being held almost horizontal, the cleaning step being performed by using cavitation jet means having a plurality of nozzles arranged above and below the thin metal plate such that the axes of the plurality of nozzles are substantially at right angles with a direction of conveyance of the thin metal plate, wherein the cavitation jet means sprays the etching inhibiting solution upon upper and lower surfaces of the thin metal plate to thereby generate cavitation near the upper and lower surfaces of the thin metal plate.

3. A method according to claim 1, wherein the cleaning step is performed by supplying the etching inhibiting solution to an etching inhibiting solution tank and dipping the thin metal plate being conveyed into said etching inhibiting solution tank.

4. A shadow mask manufacturing method comprising:

the step of etching a band-like thin metal plate on two surfaces of which etching protective layers each having a pattern corresponding to apertures in a shadow mask on at least one surface thereof are formed;

the etching protective layer stripping step of stripping the etching protective layers; and the step of performing rapid cleaning by spraying a cleaning solution, which is inert with respect to the band-like thin metal plate, upon upper and lower surfaces of the band-like thin metal plate and thereby generating cavitation near the surfaces of the band-like thin metal plate by using cavitation jet means, while regulating a position of the band-like thin metal plate and preventing the cleaning solution from leaking in a direction opposite to the conveyance direction of the band-like thin metal plate by using a first leakage-preventing seal unit provided closely upstream said cavitation jet means.

5. A method according to claim 4, wherein said cavitation jet means comprises:

a first spray unit arranged above the thin metal plate and having a plurality of nozzles, for spraying the cleaning solution at a high pressure downward, aligned in a direction substantially perpendicular to the conveyance direction of the thin metal plate; and a second spray unit arranged below the thin metal plate and having a plurality of nozzles, for spraying the cleaning solution at a high pressure upward, aligned in a direction substantially perpendicular to the conveyance direction of the thin metal plate.

6. A method according to claim 4, wherein said first leakage-preventing seal unit comprises a pair of pre-stage rollers for clamping the band-like thin metal plate.

7. A method according to claim 4, wherein a second leakage-preventing seal unit is further provided downstream said cleaning unit to regulate the position of the band-like thin metal plate and prevent the cleaning solution from leaking in the conveyance direction of the band-like thin metal plate.

8. A method according to claim 7, wherein said second leakage-preventing seal unit comprises a pair of post-stage rollers for clamping the band-like thin metal plate.

9. A method according to claim 4, wherein the cleaning solution which is inert with respect to the band-like thin metal plate is water.

10. A method according to claim 9, wherein the cleaning solution which is inert with respect to the band-like thin metal plate is cold water at a temperature of 5 to 20° C.

11. A method according to claim 7, wherein said second leakage-preventing seal unit is provided downstream to said cleaning unit.

12. A shadow mask manufacturing method comprising the steps of:

forming etching protective layers on both sides of a thin metal plate, where each protective layer has a pattern corresponding to apertures to be formed in the thin metal plate;

etching the thin metal plate on which the etching protective layers are formed by using an etching solution containing ferric chloride; and cleaning the thin metal plate by removing the etching solution residue after the etching step with an etching inhibiting solution which is inert with respect to the thin metal plate, and which comprises a solution containing a metal ion having an ionization tendency higher than an ionization tendency of trivalent iron, wherein the solution containing the metal ion contains at least one solution selected from the group consisting of an aqueous nickel chloride solution, an aqueous cobalt chloride solution, an aqueous potassium chloride solution, an aqueous calcium chloride solution, an aqueous magnesium chloride solution, an aqueous lithium chloride solution, an aqueous zinc chloride solution, an aqueous manganese chloride solution, and an aqueous ferrous chloride solution.

13. A shadow mask manufacturing method comprising the steps of:

forming etching protective layers on both sides of a thin metal plate, where each protective layer has a pattern corresponding to apertures to be formed in the thin metal plate;

etching the thin metal plate on which the etching protective layers are formed by using an etching solution containing ferric chloride; and cleaning the thin metal plate by removing etching solution residue with an etching inhibiting solution which is inert with respect to the thin metal plate, and which comprises a solution containing a metal ion having an ionization tendency higher than an ionization tendency of trivalent iron, wherein the solution containing the metal ion consists of a saturated aqueous solution of a salt of the metal.

14. A shadow mask manufacturing method according to claim 2, wherein the etching inhibiting solution is sprayed at a pressure between 5 to 15 kgf/cm2.

* * * * *